US009120006B2

(12) United States Patent
Palmer

(10) Patent No.: US 9,120,006 B2
(45) Date of Patent: Sep. 1, 2015

(54) COMBINATION POKER AND SIMULATED SPORTING EVENT WAGERING GAME

(76) Inventor: Edward L. Palmer, San Antonio, TX (US)

( * ) Notice: Subject to any disclaimer, the term of this patent is extended or adjusted under 35 U.S.C. 154(b) by 2047 days.

(21) Appl. No.: 11/707,554

(22) Filed: Feb. 16, 2007

(65) Prior Publication Data

US 2008/0197573 A1 Aug. 21, 2008

(51) Int. Cl.
*A63F 1/04* (2006.01)
*A63F 1/00* (2006.01)

(52) U.S. Cl.
CPC ..... *A63F 1/04* (2013.01); *A63F 2001/005* (2013.01)

(58) Field of Classification Search
CPC ..... A63F 1/04; A63F 2001/005
USPC ..... 273/274, 292, 298, 304
See application file for complete search history.

(56) References Cited

U.S. PATENT DOCUMENTS

| | | | | | |
|---|---|---|---|---|---|
| 1,557,284 | A | * | 10/1925 | Horowitz | 273/298 |
| 1,693,525 | A | * | 11/1928 | Niederlitz | 273/304 |
| 2,060,973 | A | * | 11/1936 | Brown, Jr. et al. | 273/244 |
| 2,064,466 | A | * | 12/1936 | Downey | 273/296 |
| 2,355,785 | A | | 8/1944 | Dorfman | |
| 4,252,321 | A | * | 2/1981 | Hopwood | 273/247 |
| 4,793,617 | A | | 12/1988 | Sanon | |
| 4,836,553 | A | | 6/1989 | Suttle et al. | |
| 4,948,134 | A | | 8/1990 | Suttle et al. | |
| 5,145,173 | A | * | 9/1992 | Crowder | 273/298 |
| 5,165,693 | A | * | 11/1992 | Handlon, Sr. | 273/298 |
| 5,395,119 | A | * | 3/1995 | Jacob et al. | 273/274 |
| 5,403,013 | A | * | 4/1995 | Gilbert | 273/287 |
| 5,445,391 | A | * | 8/1995 | Gleason, Jr. | 273/304 |
| 5,496,036 | A | | 3/1996 | Chester | |
| 5,718,432 | A | * | 2/1998 | Fraser | 273/304 |
| 5,749,581 | A | | 5/1998 | Poisson | |
| 5,820,461 | A | | 10/1998 | Pernatozzi | |
| 6,012,721 | A | | 1/2000 | Harnish | |
| 6,102,402 | A | * | 8/2000 | Scott et al. | 273/292 |
| 6,227,544 | B1 | | 5/2001 | White et al. | |
| 6,267,669 | B1 | | 7/2001 | Luciano, Jr. et al. | |
| 6,565,092 | B1 | | 5/2003 | McCarthy, Jr. | |
| 6,626,434 | B2 | | 9/2003 | Tanaka | |

(Continued)

OTHER PUBLICATIONS http://www.boardgamegeek.com/game/22924, Card Football, 2006.*

*Primary Examiner* — William Pierce
(74) *Attorney, Agent, or Firm* — Kammer Browning PLLC

(57) ABSTRACT

A game method of play that combines features of the game of poker with features from a variety of competitive sporting events. A deck of 56 cards is utilized containing four suits and fourteen rank cards for each suit (the rank of "1" for each suit is added to a standard deck of 52 cards). Indicated on the face of each card is a scoring value associated with a particular sporting event competition. The players carry out the play of the game in a manner similar to that of poker, playing for a poker outcome using the poker values, as well as a scoring outcome using the sports scoring indicia on the cards accumulated in the player's hand. Depending on the embodiment of the game being played, winning can occur in three ways: by holding the best poker hand value; by holding the best scoring hand value; or by having the best cumulative scoring outcome over multiple hands. In this manner, players bet during the play of the game on both the anticipated value of their poker hand and the anticipated value of the sporting event scoring values reflected on the cards they retain. Score cards and rank value reference cards facilitate the play of the game and the process of betting on the outcome.

25 Claims, 24 Drawing Sheets

(56) References Cited

U.S. PATENT DOCUMENTS

| | | | | |
|---|---|---|---|---|
| 6,663,107 | B2 | 12/2003 | Fisher et al. | |
| 7,451,986 | B1 * | 11/2008 | Thrasher | 273/259 |
| 2004/0066002 | A1 * | 4/2004 | Spring | 273/298 |
| 2004/0195768 | A1 * | 10/2004 | Poulos | 273/244 |
| 2005/0035549 | A1 * | 2/2005 | Zeng | 273/292 |
| 2005/0070351 | A1 * | 3/2005 | Reeves | 463/16 |
| 2006/0019742 | A1 * | 1/2006 | Reeves | 463/25 |
| 2006/0094490 | A1 * | 5/2006 | Reeves | 463/16 |
| 2007/0018406 | A1 * | 1/2007 | Kennedy | 273/307 |
| 2007/0194531 | A1 * | 8/2007 | Fujka et al. | 273/292 |
| 2007/0197247 | A1 * | 8/2007 | Inselberg | 455/517 |
| 2007/0252334 | A1 * | 11/2007 | McCormick | 273/292 |
| 2007/0278742 | A1 * | 12/2007 | Kroner | 273/259 |
| 2008/0136104 | A1 * | 6/2008 | Matanky | 273/292 |
| 2008/0194307 | A1 * | 8/2008 | Sanger | 463/4 |

* cited by examiner

FOOTBALL POKER

RANK VALUES

| RANK | ♥ | ♦ | ♠ | ♣ |
|---|---|---|---|---|
| | POINTS | | | |
| A | 7 | 0 | 7 | 0 |
| K | 0 | 6 | 0 | 6 |
| Q | 3 | 3 | 3 | 3 |
| J | 0 | 0 | 0 | 0 |
| 10 | 0 | 0 | 0 | 0 |
| 9 | 0 | 0 | 0 | 0 |
| 8 | 0 | 0 | 0 | 0 |
| 7 | 0 | 0 | 0 | 0 |
| 6 | 0 | 0 | 0 | 0 |
| 5 | 0 | 0 | 0 | 0 |
| 4 | 0 | 0 | 0 | 0 |
| 3 | 3 | 3 | 3 | 3 |
| 2 | 6 | 0 | 6 | 0 |
| 1 | 0 | 7 | 0 | 7 |

NO PAIR = 0 Points 50 52 54

Fig. 3A

FOOTBALL POKER

RANK VALUES

| RANK | ♥ | ♦ | ♠ | ♣ |
|---|---|---|---|---|
| | GAME SCORE | | | |
| A | 24 | 21 | 20 | 17 |
| K | 16 | 14 | 13 | 12 |
| Q | 6 | 7 | 9 | 10 |
| J | 0 | 0 | 0 | 0 |
| 10 | 0 | 0 | 0 | 6 |
| 9 | 3 | 0 | 0 | 0 |
| 8 | 0 | 0 | 0 | 0 |
| 7 | 0 | 0 | 2 | 0 |
| 6 | 0 | 0 | 0 | 3 |
| 5 | 6 | 0 | 0 | 0 |
| 4 | 0 | 0 | 0 | 0 |
| 3 | 10 | 9 | 7 | 6 |
| 2 | 12 | 13 | 14 | 16 |
| 1 | 17 | 20 | 21 | 24 |

NO PAIR = 0 Points
(Hold 4 – 7's Score 28 Points)

51 53 55

Fig. 3B

BASEBALL POKER RANK VALUES

| RANK | ♥ | ♦ | ♠ | ♣ |
|---|---|---|---|---|
| | RUNS | | | |
| A | 0 | 1 | 1 | 1 |
| K | 1 | 1 | 0 | 1 |
| Q | 1 | 1 | 1 | 0 |
| J | 0 | 0 | 0 | 0 |
| 10 | 0 | 0 | 0 | 0 |
| 9 | 0 | 0 | 0 | 0 |
| 8 | 0 | 0 | 0 | 0 |
| 7 | 0 | 0 | 0 | 0 |
| 6 | 0 | 0 | 0 | 0 |
| 5 | 0 | 0 | 0 | 0 |
| 4 | 1 | 1 | 1 | 1 |
| 3 | 0 | 1 | 1 | 1 |
| 2 | 1 | 1 | 0 | 1 |
| 1 | 1 | 1 | 1 | 0 |

NO PAIR = 0 Runs 56 58 60

BASEBALL POKER RANK VALUES

| RANK | ♥ | ♦ | ♠ | ♣ |
|---|---|---|---|---|
| | TOTAL RUNS | | | |
| A | 15 | 14 | 13 | 12 |
| K | 11 | 10 | 9 | 8 |
| Q | 7 | 6 | 5 | 4 |
| J | 0 | 0 | 0 | 0 |
| 10 | 3 | 2 | 1 | 1 |
| 9 | 1 | 0 | 1 | 0 |
| 8 | 0 | 0 | 0 | 0 |
| 7 | 1 | 0 | 1 | 0 |
| 6 | 1 | 0 | 1 | 0 |
| 5 | 1 | 1 | 2 | 3 |
| 4 | 0 | 0 | 0 | 0 |
| 3 | 4 | 5 | 6 | 7 |
| 2 | 8 | 9 | 10 | 11 |
| 1 | 12 | 13 | 14 | 15 |

NO PAIR = 0 Runs
(Hold 4--4's Score 16 Runs)

57 59 61

BASKETBALL POKER 97 — RANK VALUES

| RANK | ♥ | ♦ | ♠ | ♣ |
|---|---|---|---|---|
| | GAME SCORE | | | |
| A | 110 | 109 | 108 | 107 |
| K | 103 | 104 | 105 | 106 |
| Q | 102 | 101 | 100 | 99 |
| J | 85 | 85 | 85 | 85 |
| 10 | 95 | 96 | 97 | 98 |
| 9 | 94 | 93 | 92 | 91 |
| 8 | 84 | 84 | 84 | 84 |
| 7 | 90 | 89 | 88 | 87 |
| 6 | 91 | 92 | 93 | 94 |
| 5 | 98 | 97 | 96 | 95 |
| 4 | 86 | 86 | 86 | 86 |
| 3 | 99 | 100 | 101 | 102 |
| 2 | 108 | 105 | 104 | 103 |
| 1 | 107 | 108 | 109 | 110 |

NO PAIR = 80 Points
(Hold 4 – 3's Score 112 Points)

63 65 67

Fig. 3F

BASKETBALL POKER — RANK VALUES

| RANK | ♥ | ♦ | ♠ | ♣ |
|---|---|---|---|---|
| | POINTS | | | |
| A | 8 | 8 | 7 | 7 |
| K | 8 | 8 | 7 | 7 |
| Q | 6 | 6 | 5 | 5 |
| J | 0 | 0 | 0 | 0 |
| 10 | 3 | 3 | 4 | 4 |
| 9 | 2 | 2 | 2 | 2 |
| 8 | 0 | 0 | 0 | 0 |
| 7 | 1 | 1 | 1 | 1 |
| 6 | 2 | 2 | 2 | 2 |
| 5 | 4 | 4 | 3 | 3 |
| 4 | 0 | 0 | 0 | 0 |
| 3 | 5 | 5 | 6 | 6 |
| 2 | 6 | 6 | 7 | 7 |
| 1 | 8 | 8 | 7 | 7 |

NO PAIR = 0 Points 62 64 66

Fig. 3E

68

70

72

| GOLF POKER | RANK VALUES | | | |
|---|---|---|---|---|
| RANK | ♥ | ♦ | ♠ | ♣ |
| | HOLE SCORE | | | |
| A | Par | Par | Par | -1 |
| K | Par | Par | -1 | Par |
| Q | Par | -1 | Par | Par |
| J | +1 | +1 | +1 | Par |
| 10 | Par | Par | Par | Par |
| 9 | Par | Par | Par | Par |
| 8 | +1 | +1 | +1 | Par |
| 7 | Par | Par | Par | Par |
| 6 | Par | Par | Par | Par |
| 5 | Par | Par | Par | Par |
| 4 | +1 | +1 | +1 | Par |
| 3 | Par | -1 | Par | Par |
| 2 | Par | Par | -1 | Par |
| 1 | Par | Par | Par | -1 |
| NO PAIR = Par + 3 | | | | |

Fig. 3G

69

71

73

| GOLF POKER SV | RANK VALUES | | | |
|---|---|---|---|---|
| RANK | ♥ | ♦ | ♠ | ♣ |
| | TOTAL STROKES | | | |
| A | 64 | 64 | 65 | 65 |
| K | 66 | 66 | 67 | 67 |
| Q | 68 | 68 | 69 | 69 |
| J | 76 | 76 | 76 | 76 |
| 10 | 70 | 70 | 71 | 71 |
| 9 | 72 | 72 | 73 | 73 |
| 8 | 78 | 78 | 78 | 78 |
| 7 | 74 | 74 | 75 | 75 |
| 6 | 72 | 72 | 73 | 73 |
| 5 | 70 | 70 | 71 | 71 |
| 4 | 77 | 77 | 77 | 77 |
| 3 | 68 | 68 | 69 | 69 |
| 2 | 66 | 66 | 67 | 67 |
| 1 | 64 | 64 | 65 | 65 |
| NO PAIR = Score 80 (Hold 4 -- 1's Score 63) | | | | |

Fig. 3H

74

76

78

| BOWLING POKER | RANK VALUES | | | |
|---|---|---|---|---|
| RANK | ♥ | ♦ | ♠ | ♣ |
| | PIN COUNT | | | |
| A | ST | ST | ST | ST |
| K | ST | ST | ST | ST |
| Q | 9/1 | 9/1 | 9/1 | 9/1 |
| J | 5/2 | 5/2 | 5/2 | 5/2 |
| 10 | 8/2 | 8/2 | 8/2 | 8/2 |
| 9 | 7/3 | 7/3 | 7/3 | 7/3 |
| 8 | 6/1 | 6/1 | 6/1 | 6/1 |
| 7 | 9/1 | 9/1 | 9/1 | 9/1 |
| 6 | 7/3 | 7/3 | 7/3 | 7/3 |
| 5 | 8/2 | 8/2 | 8/2 | 8/2 |
| 4 | 7/0 | 7/0 | 7/0 | 7/0 |
| 3 | 9/1 | 9/1 | 9/1 | 9/1 |
| 2 | ST | ST | ST | ST |
| 1 | ST | ST | ST | ST |
| NO PAIR = Score 6/0 for Frame | | | | |

Fig. 3I

75

77

79

| BOWLING POKER SV | RANK VALUES | | | |
|---|---|---|---|---|
| RANK | ♥ | ♦ | ♠ | ♣ |
| | TOTAL PIN COUNT | | | |
| A | 298 | 296 | 294 | 292 |
| K | 290 | 288 | 286 | 284 |
| Q | 282 | 280 | 278 | 275 |
| J | 195 | 195 | 195 | 195 |
| 10 | 270 | 265 | 260 | 255 |
| 9 | 250 | 245 | 240 | 235 |
| 8 | 190 | 190 | 190 | 190 |
| 7 | 230 | 225 | 220 | 215 |
| 6 | 250 | 245 | 240 | 235 |
| 5 | 270 | 265 | 260 | 255 |
| 4 | 195 | 195 | 195 | 195 |
| 3 | 283 | 281 | 279 | 276 |
| 2 | 291 | 289 | 287 | 285 |
| 1 | 299 | 297 | 295 | 293 |
| NO PAIR = Score 180 (Hold 4 – 10's Score 300) | | | | |

Fig. 3J

DARTS POKER RANK VALUES

| RANK | ♥ | ♦ | ♠ | ♣ |
|---|---|---|---|---|
| | POINTS PER DART | | | |
| A | 50 | 25 | 25 | 25 |
| K | 20 | 20 | 20 | 1 |
| Q | 18 | 18 | 18 | 2 |
| J | 16 | 16 | 16 | 4 |
| 10 | 14 | 14 | 14 | 6 |
| 9 | 12 | 12 | 12 | 8 |
| 8 | 1 | 1 | 1 | 0 |
| 7 | 10 | 10 | 10 | 8 |
| 6 | 12 | 12 | 12 | 8 |
| 5 | 14 | 14 | 14 | 6 |
| 4 | 16 | 16 | 16 | 4 |
| 3 | 18 | 18 | 18 | 2 |
| 2 | 20 | 20 | 20 | 1 |
| 1 | 25 | 25 | 25 | 50 |

NO PAIR = 0 Points 80 82 84

Fig. 3K

DARTS POKER RANK VALUES

| RANK | ♥ | ♦ | ♠ | ♣ |
|---|---|---|---|---|
| | TOTAL GAME SCORE | | | |
| A | 498 | 496 | 494 | 492 |
| K | 484 | 486 | 488 | 490 |
| Q | 482 | 480 | 478 | 476 |
| J | 450 | 450 | 450 | 450 |
| 10 | 468 | 470 | 472 | 474 |
| 9 | 466 | 464 | 462 | 460 |
| 8 | 450 | 450 | 450 | 450 |
| 7 | 458 | 456 | 454 | 452 |
| 6 | 460 | 462 | 464 | 466 |
| 5 | 474 | 472 | 470 | 468 |
| 4 | 450 | 450 | 450 | 450 |
| 3 | 476 | 478 | 480 | 482 |
| 2 | 490 | 488 | 486 | 484 |
| 1 | 492 | 494 | 496 | 498 |

NO PAIR = 450 Points 81 83 85

Fig. 3L

| RANK | ♥ | ♦ | ♠ | ♣ |
|---|---|---|---|---|
| | TOTAL POUNDS | | | |
| A | 79 | 78 | 77 | 76 |
| K | 75 | 74 | 73 | 72 |
| Q | 71 | 70 | 69 | 68 |
| J | 55 | 55 | 55 | 55 |
| 10 | 67 | 66 | 65 | 64 |
| 9 | 63 | 62 | 61 | 60 |
| 8 | 53 | 53 | 53 | 53 |
| 7 | 59 | 58 | 57 | 56 |
| 6 | 60 | 61 | 62 | 63 |
| 5 | 64 | 65 | 66 | 67 |
| 4 | 55 | 55 | 55 | 55 |
| 3 | 68 | 69 | 70 | 71 |
| 2 | 72 | 73 | 74 | 75 |
| 1 | 76 | 77 | 78 | 79 |

NO PAIR = 50 Pounds

| RANK | ♥ | ♦ | ♠ | ♣ |
|---|---|---|---|---|
| | POUNDS | | | |
| A | 10 | 8 | 8 | 8 |
| K | 6 | 6 | 6 | 0 |
| Q | 4 | 0 | 4 | 4 |
| J | 0 | 0 | 0 | 0 |
| 10 | 0 | 2 | 2 | 2 |
| 9 | 1 | 0 | 1 | 1 |
| 8 | 0 | 0 | 0 | 0 |
| 7 | 0 | 1 | 1 | 1 |
| 6 | 1 | 1 | 0 | 1 |
| 5 | 2 | 2 | 0 | 2 |
| 4 | 0 | 0 | 0 | 0 |
| 3 | 0 | 4 | 4 | 4 |
| 2 | 6 | 6 | 0 | 6 |
| 1 | 8 | 8 | 12 | 8 |

NO PAIR = 0 Pounds

92

94

96

Deer Hunting POKER — RANK VALUES

| RANK | ♥ | ♦ | ♠ | ♣ |
|---|---|---|---|---|
| | RACK POINT COUNT | | | |
| A | 3 | 3 | 3 | 3 |
| K | 3 | 3 | 2 | 2 |
| Q | 2 | 2 | 2 | 2 |
| J | MISS | MISS | MISS | MISS |
| 10 | 1 | 1 | 2 | 2 |
| 9 | 1 | 1 | 1 | 1 |
| 8 | MISS | MISS | MISS | MISS |
| 7 | 1 | 1 | 1 | 1 |
| 6 | 1 | 1 | 1 | 1 |
| 5 | 2 | 2 | 1 | 1 |
| 4 | MISS | MISS | MISS | MISS |
| 3 | 2 | 2 | 2 | 2 |
| 2 | 2 | 2 | 3 | 3 |
| 1 | 3 | 3 | 3 | 3 |

NO PAIR = Miss (0 Points)

Fig. 3P

93

95

97

Deer Hunting POKER 2V — RANK VALUES

| RANK | ♥ | ♦ | ♠ | ♣ |
|---|---|---|---|---|
| | TOTAL RACK POINTS | | | |
| A | 12 | 10 | 12 | 10 |
| K | 10 | 8 | 10 | 8 |
| Q | 8 | 6 | 8 | 6 |
| J | MISS | MISS | MISS | MISS |
| 10 | 6 | 4 | 6 | 4 |
| 9 | 4 | 2 | 4 | 2 |
| 8 | MISS | MISS | MISS | MISS |
| 7 | 2 | 0 | 2 | 0 |
| 6 | 4 | 2 | 4 | 2 |
| 5 | 6 | 4 | 6 | 4 |
| 4 | MISS | MISS | MISS | MISS |
| 3 | 8 | 6 | 8 | 6 |
| 2 | 10 | 8 | 10 | 8 |
| 1 | 12 | 10 | 12 | 10 |

NO PAIR = Miss (0 Points)

Fig. 3Q

98

100

102

Horse Racing POKER RANK VALUES

| RANK | ♥ | ♦ | ♠ | ♣ |
|---|---|---|---|---|
| | SECONDS | | | |
| A | 11 | 11 | 11 | 11 |
| K | $11^{5}$ | $11^{5}$ | $11^{5}$ | $11^{5}$ |
| Q | 12 | 12 | 12 | 12 |
| J | 14 | 14 | 14 | 14 |
| 10 | 13 | 13 | 13 | 13 |
| 9 | 13 | 13 | 13 | 13 |
| 8 | 14 | 14 | 14 | 14 |
| 7 | 13 | 13 | 13 | 13 |
| 6 | 13 | 13 | 13 | 13 |
| 5 | 13 | 13 | 13 | 13 |
| 4 | 14 | 14 | 14 | 14 |
| 3 | 12 | 12 | 12 | 12 |
| 2 | $11^{5}$ | $11^{5}$ | $11^{5}$ | $11^{5}$ |
| 1 | 11 | 11 | 11 | 11 |

NO PAIR = 15 Seconds

Fig. 3R

99

101

103

Horse Racing POKER SV RANK VALUES

| RANK | ♥ | ♦ | ♠ | ♣ |
|---|---|---|---|---|
| | FINISH POSITION | | | |
| A | 3rd | 3rd | 3rd | 3rd |
| K | 5th | 5th | 5th | 5th |
| Q | 7th | 7th | 7th | 7th |
| J | SC | SC | SC | SC |
| 10 | 9th | 9th | 9th | 9th |
| 9 | 11th | 11th | 11th | 11th |
| 8 | SC | SC | SC | SC |
| 7 | 12th | 12th | 12th | 12th |
| 6 | 10th | 10th | 10th | 10th |
| 5 | 8th | 8th | 8th | 8th |
| 4 | SC | SC | SC | SC |
| 3 | 6th | 6th | 6th | 6th |
| 2 | 4th | 4th | 4th | 4th |
| 1 | 2nd | 2nd | 2nd | 2nd |

NO PAIR = Scratch

Fig. 3S

104

Auto Racing POKER RANK VALUES

| RANK | ♥ | ♦ | ♠ | ♣ |
|---|---|---|---|---|
| | MILES | | | |
| A | 50 | 50 | 40 | 40 |
| K | 30 | 30 | 40 | 40 |
| Q | 20 | 20 | 30 | 30 |
| J | -10 | -10 | -10 | -10 |
| 10 | 20 | 20 | 10 | 10 |
| 9 | 10 | 10 | 10 | 10 |
| 8 | -20 | -20 | -20 | -20 |
| 7 | 10 | 10 | 10 | 10 |
| 6 | 10 | 10 | 10 | 10 |
| 5 | 10 | 10 | 20 | 20 |
| 4 | -10 | -10 | -10 | -10 |
| 3 | 30 | 30 | 20 | 20 |
| 2 | 40 | 40 | 30 | 30 |
| 1 | 40 | 40 | 50 | 50 |

NO PAIR = 0 Miles

106

108

Fig. 3T

105

Auto Racing POKER 3V RANK VALUES

| RANK | ♥ | ♦ | ♠ | ♣ |
|---|---|---|---|---|
| | FINISH POSITION | | | |
| A | 2nd | 4th | 6th | 8th |
| K | 10th | 12th | 14th | 16th |
| Q | 18th | 20th | 22nd | 24th |
| J | OUT | OUT | OUT | OUT |
| 10 | 26th | 28th | 30th | 32nd |
| 9 | 34th | 36th | 38th | 40th |
| 8 | OUT | OUT | OUT | OUT |
| 7 | 42nd | 43rd | 44th | 45th |
| 6 | 35th | 37th | 39th | 41st |
| 5 | 27th | 29th | 31st | 33rd |
| 4 | OUT | OUT | OUT | OUT |
| 3 | 19th | 21st | 23rd | 25th |
| 2 | 11th | 13th | 15th | 17th |
| 1 | 3rd | 5th | 7th | 9th |

NO PAIR = OUT of Race
(Hold 4 – 1's Finish in First Place)

107

109

Fig. 3U

Golf Poker Scorecard

| HOLE | 1 | 2 | 3 | 4 | 5 | 6 | 7 | 8 | 9 | Front | 10 | 11 | 12 | 13 | 14 | 15 | 16 | 17 | 18 | Back | Total |
|---|---|---|---|---|---|---|---|---|---|---|---|---|---|---|---|---|---|---|---|---|---|
| PAR | 4 | 5 | 4 | 3 | 4 | 4 | 5 | 3 | 4 | Par 36 | 4 | 3 | 4 | 5 | 4 | 4 | 3 | 5 | 4 | Par 36 | Par 72 |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |

114

Bowling Poker Scorecard

| | Frame 1 | Frame 2 | Frame 3 | Frame 4 | Frame 5 | Frame 6 | Frame 7 | Frame 8 | Frame 9 | Frame 10 |
|---|---|---|---|---|---|---|---|---|---|---|
| Player 1 | | | | | | | | | | |
| Player 2 | | | | | | | | | | |
| Player 3 | | | | | | | | | | |
| Player 4 | | | | | | | | | | |
| Player 5 | | | | | | | | | | |
| Player 6 | | | | | | | | | | |
| Player 7 | | | | | | | | | | |

116

COMBINATION POKER AND SIMULATED SPORTING EVENT WAGERING GAME

BACKGROUND OF THE INVENTION

1. Field of the Invention

The present invention relates generally to card games and sport competitions and to methods for carrying out the play of each in a combined manner. The present invention relates more specifically to a poker game method of play that incorporates rules and scoring that simulate the play of a sporting event.

2. Description of the Related Art

Card games played with a standard deck of 52 cards remain very popular whether in an informal environment (as a "parlor" game), a more formal gambling environment (as a "casino" game), or an electronic environment (as a "video" game). The card game of poker, in its various forms and formats, has in fact enjoyed a significant resurgence in recent years. Equally popular as entertainment diversions (as well as the focus of gambling) are sporting events and sport competitions. Although the play of the card game of poker is quite different from the play of most sport competitions, the individuals drawn to participate as players or spectators to these two activities are often the same.

Some efforts have been made in the past to combine the play of a simulated sporting event with games involving a deck of cards. The efforts in the past generally fall into a number of discrete categories. A first set of game methods of play utilize a standard deck of cards (52 cards in 4 suits of 13 ranked cards each suit) simply as a mechanism for generating random events that can be associated with events in the sports competition. In other words, a particular card in a standard 52-card deck may, by rule, be associated with a particular sport action event (a base hit, a field goal, a free throw, etc.) in a manner that allows the players to direct and determine the progress of a sporting event simulation according to the directives generated by progressively turning or playing the cards in a standard deck. Examples of patents that reflect such game methods of play are provided below and include patents issued to McCarthy, Jr. and Crowder.

A second type of game method of play developed in the past incorporates card games and sporting events in a manner that generally dispenses with a standard deck of cards and replaces it with cards bearing specific indicia and instructions for proceeding with the simulation of the sporting event. For the most part, these sporting event simulation game methods of play, and the devices and materials they describe using, do not incorporate specialized indicia onto a standard deck of cards, but rather start from scratch with a completely unique set of cards. Examples of patents that reflect such game methods of play are provided below and include patents issued to Fisher et al., Chester, Poisson, Tanaka, White et al., Sanon, and Harnish.

A number of additional efforts have been made in the past that describe the concept of combining secondary methods of play in conjunction with the play of poker. Typical among these is a game product that has been on the market for some time, known as PO-KE-NO®. PO-KE-NO® is a game that combines elements of bingo with keno and poker. This game however does not incorporate rules or scoring associated with a sporting event in combination with the rules of the game of poker.

There have also been efforts in the past to integrate poker games into the video and Internet environment. The flexibility that such environments provide allows the addition of features to the game that go well beyond the basic features associated with a 52-card deck poker game. Examples of patents that reflect such video game methods of play are provided below and include patents issued to Lucianno, Jr. et al. and Suttle et al.

In general therefore, there have been efforts made in the past to diversify and vary the play of poker by adding features of other card games or other games of chance. There have also been efforts to simulate the play of sporting events with unique decks of cards that introduce the randomness of the shuffled deal into the game method of play. Both poker and sporting events have been separately introduced into the electronic gaming environment. Nothing in the prior art however, has adequately combined the game method of poker with the competitive scoring associated with a variety of sporting events. Some of the efforts in the past described above include those reflected in the following U.S. Patents.

U.S. Pat. No. 5,820,461 issued to Pernatozzi on Oct. 13, 1998, entitled Game for a Casino describes a video slot machine game that combines (in a video environment) a baseball configuration including first base, second base, third base, and home plate in connection with the progressive appearance of cards from a deck. Various methods for scoring and providing point totals as well as controlling the play of the game are described. Wagers are typically placed in a progressive manner as the game proceeds from first base through to home plate.

U.S. Pat. No. 6,267,669 issued to Lucianno, Jr. et al. on Jul. 31, 2001, entitled Hybrid Gaming Apparatus and Method describes a combination game that includes coordination and dexterity aspects, as well as traditional game rules of play. The player performs a first stage of the game that requires dexterity and then a second stage of the game play that depends upon the occurrence of certain predefined events.

U.S. Pat. No. 6,012,721 issued to Harnish on Jan. 11, 2000, entitled Basketball Card Game describes both an apparatus and a method for carrying out a sports card game, specifically a basketball game. The game materials include a deck of cards and dice for generating random numbers. Each card describes an event in the game method of play and the dice are utilized to determine the success of the event. The objective is to make certain events occur as frequently during the game as similar events would occur in the actual sporting event.

U.S. Pat. No. 4,793,617 issued to Sanon on Dec. 27, 1988, entitled Tennis Card Game provides a game method of play utilizing three decks of playing cards, two decks being identical and bearing indicia representative of typical tennis strokes, and a third deck (a "serving" deck) that contains cards bearing indicia representative of service conditions. Cards are drawn by the respective player to determine the results of the play of the game, typically along the lines of progress in a tennis match.

U.S. Pat. No. 6,227,544 issued to White et al. on May 8, 2001, entitled Card Game for the Simulation of a Sports Game describes an apparatus for playing a game that includes a set of opaque cards, each having two opposite faces carrying markings that are used in playing the game. Each card contains regions that are divided into two sets, one for each of the two opposing teams. One face of each card bears the representation of a ball (being handled in some action) and the opposite face carries a representation of a defending player.

U.S. Pat. No. 6,565,092 issued to McCarthy, Jr. on May 20, 2003, entitled Hockey Card Game describes a card game played in conjunction with an erasable board. The game uses three 52-card playing decks to simulate real ice hockey matches. The hockey game incorporates a variety of circumstances and activities (such as actions) that include major and minor penalties, penalty shots, goal shots, puck passes, oneman power plays, two-man power plays, offensive and defensive open net, and breakaway situations.

U.S. Pat. No. 6,626,434 issued to Tanaka on Sep. 30, 2003, entitled Baseball Card Game describes the use of a specialized deck of cards referred to as player cards that contain player photographs as well as various types of additional information utilized for scoring during the play of the game. The information includes a batting table as well as fielding force indicators related to the position of the player. The play involves progressive reference to a pitcher card, as well as fielding force indicators on a player card. Batting table indicators on a player card provide the offensive scoring mechanism for the game.

U.S. Pat. No. 6,663,107 issued to Fisher et al. on Dec. 16, 2003, entitled Card Game describes an apparatus and method for playing a card game while watching a sporting event such as a baseball game. Players in the game select cards from the cards they are dealt which describe a result that the card game player believes is most likely to occur during the play of the actual sporting event being watched (live on TV for example). The game proceeds in a manner parallel to that associated with the actual sporting event being watched.

U.S. Pat. No. 5,496,036 issued to Chester on Mar. 5, 1996, entitled Football Card Board Game describes an apparatus, and method incorporating two parallel football fields on a dry erase board surface. Using color markers and the like, players indicate the progress of each of their possessions of the ball during the game. The game includes a number of dice as well as a pack of 54 cards.

U.S. Pat. No. 5,749,581 issued to Poisson on May 12, 1998, entitled Apparatus and Method of Playing a Basketball Board Game describes a game method of play that includes a design layout of a basketball court on a game board as well as a deck of passing cards, a deck of rebound cards, a deck of foul shot cards, and a deck of playing cards. Most of the cards in the game carry instructions used to replicate the progress of a basketball game.

U.S. Pat. No. 2,355,785 issued to Dorfman entitled Game or Similar Device describes a card game that utilizes a conventional playing card deck. A game board is described that includes a number of rows of fields arranged and spaced in a table format. Each of the sections on the game board is sized to allow the positioning of a number of the playing cards. The game to be played is similar to that of the game of poker and includes a specific manner of wagering on the winner of a hand of poker.

U.S. Pat. No. 5,145,173 issued to Crowder on Sep. 8, 1992 entitled Baseball Game describes a game method of play utilizing baseball player trading cards, a die and a deck of standard playing cards. The player cards are divided into teams, each with a pitcher, and a die is tossed to determine which player or pitcher is used. A standard playing card is then selected to determine which cell in the matrix creates the play simulating the play of a baseball game.

Once again it can be seen that most of the efforts in the previous art fall into one of the two or three categories mentioned above. One group of patent references that might be identified as "combination games" are much like the well known PO-KE-NO® game in that they combine the game of poker with a second card game or second game of chance of some type. In some cases, the process involves playing a single card game that incorporates elements of multiple games, and in other cases, the process simply involves playing a hand of poker while the same cards are being used to play a round in a second distinct game. A second group of patents that might be identified as "game actions" generally utilize or incorporate specialized decks of playing cards to establish a random method for generating different sports actions (that result in scores). Some of these patents describe game methods of play that involve the use of cards in conjunction with the simulation of a sporting event. These patents describe the use of unique cards that are not intended to be used in conjunction with additional card games, much less a game of poker. Perhaps a third group of patents can be characterized in the previous art as "wagering games" that involve the process of using a deck of cards as a mechanism for wagering on the outcome of an actual sporting event being watched.

None of the efforts in the previous art, however, truly combine the features of the game of poker with the simultaneous play of a simulated sporting event. Nothing in the earlier efforts described allows for wagering on both the results of the play of a hand of poker and the scoring results associated with the simulated play of a sporting event. It would be desirable to combine the game skills associated with the play of the game of poker (and the betting that accompanies such play) with a game method that simulates scoring in a sporting event and the accumulation of points in the sport. It would be desirable to combine these game methods of play in such a manner that provides a unique challenge to a player to make decisions regarding actions to take in the play of the dual outcome game and the process of betting on those outcomes. In other words, it would be a unique challenge to a player to balance the assembly of a "winning" poker hand with the assembly of a "winning" sports scoring hand, and further to bet on both of these outcomes at the same time.

SUMMARY OF THE INVENTION

The present invention therefore provides a wagering game that may be played in casinos, card rooms, game parlors, or in electronic gaming environments. The basic game method of play combines the standard play of poker with a scoring method that allows for simulated sporting event scores to be determined within a single hand or over multiple hands in order to determine a winning outcome for poker and the simulated sports event. The scoring system in a multiple hand embodiment (a "long version" of the game) is established through the combination of providing scoring indicia on the poker cards as well as providing specifically structured score cards to facilitate the players recording scores. The indicia scoring values that are placed directly on the playing cards are assigned to each poker rank. The preferred embodiment of the playing deck of cards used in the game includes the addition of "1" (the number one) as a rank in order to establish a unique deck of 56 cards, 14 ranks of 4 suits. The individual sports simulation games may include, but are not limited to, auto racing, baseball, basketball, bowling, darts, football, golf, hockey, horse racing, pool, soccer, and any of a number of additional sports games that rely upon scoring values as an outcome of the sporting event.

As described, the basic game method of play relates to both the game of poker and to various different sporting events. The game method of play in the preferred embodiment is actually a series of card games that use unique scoring values on each card in a manner that allows both the poker game and the simulated sports competition to be carried out at the same time. One key element of the game, therefore, is the use of unique indicia placed on the standard set of cards (as supplemented in the manner described above) that provide a point scoring mechanism related to the sport being simulated. A second key component of the game method of play is the score keeping system, or score card, in most instances, which is used in multiple hand embodiments. Score value reference cards for each game, although duplicating the scoring information contained on the playing cards, provide a third component that facilitates the play of the game and the process of betting on the game outcome.

A number of different game methods of play are anticipated based upon the specific sporting event that is being simulated. Different decks of cards (with the same poker indicia but different scoring indicia) for each of the different sporting events are provided. In most cases, the score cards facilitate the play but are not always essential to the play of the game as appropriate rules could guide the players through the process of keeping score based upon the results of the hands dealt in the card game.

Different game methods of play are also anticipated for the basic long version (multi-hand) embodiment of the game, versus the basic short version (single hand) embodiment of the game. In the long version, sports scoring values may be accumulated over multiple hands of play. The scoring indicia on the cards, therefore, generally represent individual scoring events that might occur during the actual play of the sports competition. The number of hands played in the long version is preferably structured to result in a final score that is also representative of typical "final" scores in the actual sports competition. One the other hand, in the short version the scoring indicia on a single card is intended to be representative of a "final" score in the actual sporting event. In the short version, a "complete" sporting event game is played with each hand of poker that is played. This short version lends itself to certain environments where separate bets are placed on the poker outcome and on the scoring outcome, and are each collected as winnings for each hand as it is played. Variations on each version (short and long) are anticipated and are, in part, described herein below.

Wagering follows a method that includes steps similar to certain types of poker but with the added concern for betting on the outcome of the sport scoring part of the game in combination with the outcome of the poker hand part of the game. Variations on the method of play and the method of wagering are anticipated and described when the game is played in different environments ranging from a simple "parlor game" environment, to a "casino game" environment, to an "electronic game" environment (such as in conjunction with online poker sites).

DETAILED DESCRIPTION OF THE PREFERRED EMBODIMENTS

The present invention involves a basic game method of play with a number of distinct variations based upon a variety of different sporting events and a variety of game play environments. It will be understood by those skilled in the art that these variations, dependent upon the specific sporting event simulated and the specific gaming environment involved, all involve the same basic invention, namely a game method of play that incorporates aspects of the game of poker with aspects of accumulating scoring outcomes for competitive sporting events. The examples that are given herein and in the attached drawing figures are intended only to be illustrative of the various sporting events, scoring methods, and the various game play environments applicable to the present invention. Those skilled in the art will recognize additional sporting events not identified herein, as well as additional game play environments not identified herein, that lend themselves to similar application of the basic game method of play concept of the present invention. Where possible, examples are given of groups of similar types of sporting events (for example, those that count points versus those that involve head to head activity competition). Those skilled in the art will likewise recognize adaptations and modifications to the basic game method of play similar to the wide variety of implementations of the game of poker currently present in the prior art. In a similar manner, examples are given that emphasize play in either the long version (multi-hand), the short version (single hand), or both, even though the basic game method of play is consistent between these two general versions of the game.

For the above reasons, the following detailed description of the preferred embodiments is intended to be illustrative of the landscape of games and game play environments applicable to the present invention. Where certain sporting events are quite similar in nature, a single illustration and description may be utilized to anticipate the variety of similar sporting events that are equally applicable. All of these various modifications, adaptations, and variations are within the scope of the present invention as characterized in more specific detail in the claims appended hereto.

Figure 1:
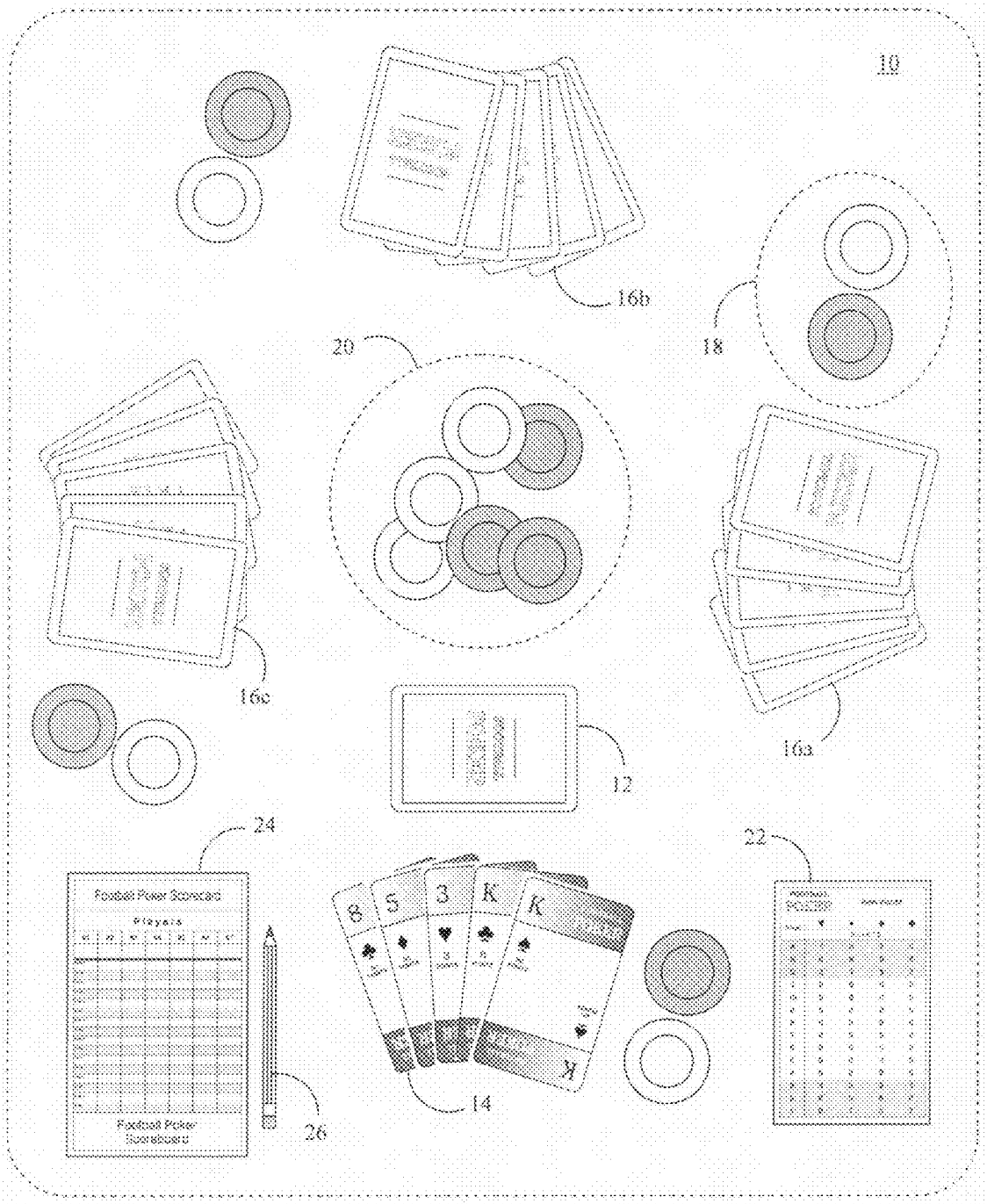
FIG. 1 is a plan view of a typical layout and distribution of the game materials of the present invention in a parlor game environment.

Reference is made first to FIG. 1 for a brief description of layout and configuration of the various game materials associated with the basic game method of play of the present invention implemented in a parlor game environment. In FIG. 1, game materials 10 generally comprise a customized deck of cards 12, characteristics of which are described in more detail below, as well as a number of additional game facilitation materials to carry out the play of the game. In FIG. 1 the game materials 10 are arranged as they might be utilized in conjunction with the parlor game embodiment of the present invention as played by four individuals in a competition against each other. In the view shown in FIG. 1, the deck of cards 12 has already been partially distributed to the players to form a first hand of cards 14 (the dealer in this case), a second hand of cards 16*a*, a third hand of cards 16*b* and a fourth hand of cards 16*c*. As described in more detail below, the players in this case do not disclose their cards to the other players, and the view in FIG. 1 is assumed to be that of the dealer with a first hand of cards 14 shown face up for illustration only.

Additional materials utilized in the game method of play include betting tokens 18, such as poker chips, at least one rank value reference card 22, a score card 24, and a pen or pencil 26 to be used in conjunction with score card 24. A number of betting tokens 18 have in this view been accumulated in the betting pot 20 in the center of the playing area. Those skilled in the art will recognize that the layout and arrangement of the game materials 10 of the present invention are similar in some respects to the basic game method of play of poker, such as in the common five-card draw poker game. The various additional materials and the methods with which these materials are utilized provide the distinctive elements of the present invention.

Figure 2A:
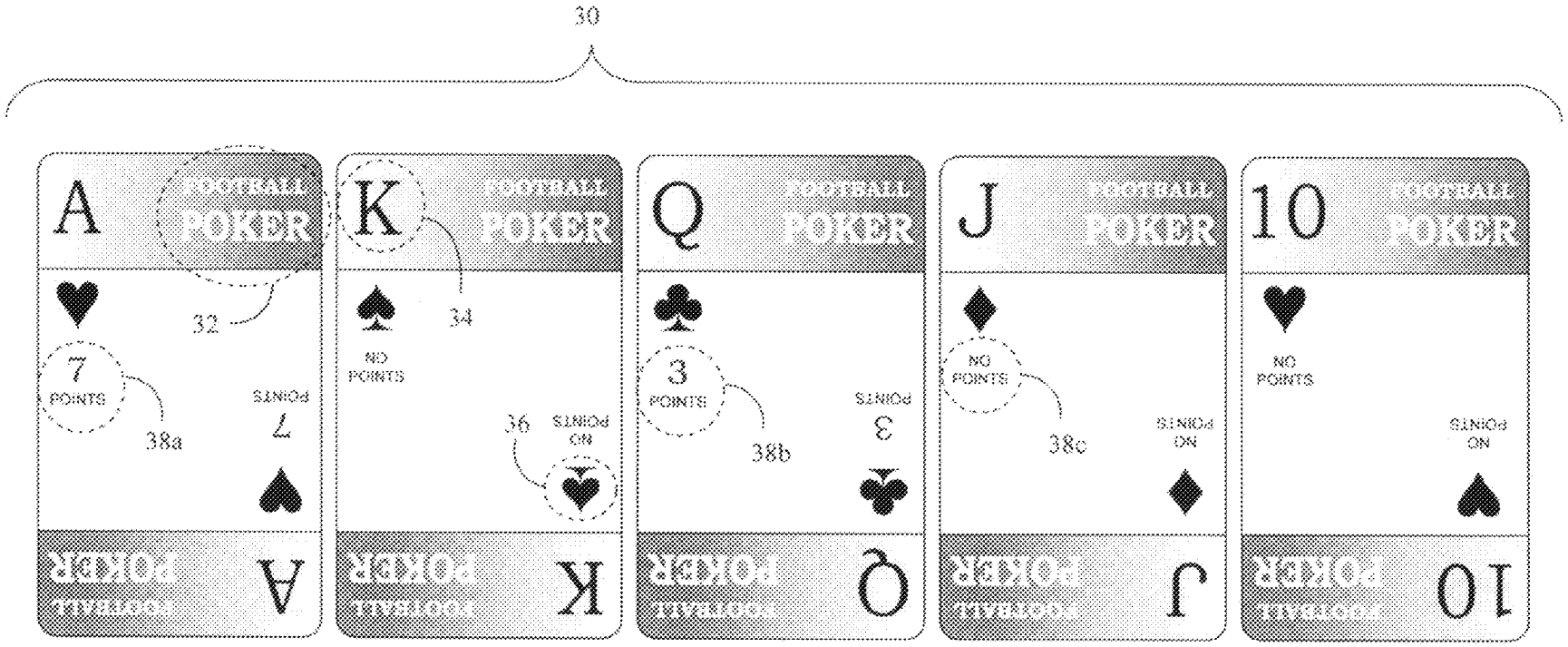
FIG. 2A is a plan view of a first example (football poker) of a representative card set for a long version (multi-hand) embodiment of the game method of play of the present invention.

Reference is now made to FIG. 2A for a brief description of a first representative card set 30 for use in conjunction with a long (multiple hand) version of the game method of play of the present invention. FIG. 2A provides a sample of the various cards utilized in conjunction with a "football poker" long version embodiment of the present invention. Football poker provides an example of the typical sporting event that involves the scoring of points during the play of the game. The faces of the representative card set 30 therefore include indicia that specify the scoring of such points in each hand of play, anticipating multiple hands of play before the game is complete.

As indicated above, the deck of cards utilized in the present invention includes 56 cards divided into groups of four different suits with individual suit card sets comprising the cards numbered 1 through 10 and Jack, Queen, King, and Ace. The representative cards shown in FIG. 2A include the "face cards" of the Ace, King, Queen, and Jack (as well as a number "10" rank card as an example). It is understood that the complete deck of cards for the play of football poker would comprise 56 cards, four different suits, and fourteen different ranks. This again is similar to a standard deck of cards with the addition of four numbered "1" cards, one of each suit.

Each of the cards in representative card set 30 bears the poker type indicia 32 to identify the type of poker to which this particular deck of cards is configured. In this case, the indicia "FOOTBALL POKER" is provided on the face of each of the cards 30. In addition, card suit indicia 36 are placed on each of the cards, again varying according to the heart, spade, club, and diamond suit configurations typically used with the standard 52 card deck. Card rank indicia 34 are provided, again as typically provided on the cards of standard decks. Also as is typically seen on standard decks of cards, the poker type indicia 32, the card rank indicia 34, and the card suit indicia 36, are all provided with mirror images oriented 180° such that the card may be easily read in either upright orientation.

The primary distinctive indicia present on card set 30 are the various card rank scoring value indicia 38*a*-38*c* shown in FIG. 2A. These scoring value indicia 38*a*-38*c* are intended to provide the means for scoring the sporting event competition that is played at the same time the poker hand is played. In this case, card rank scoring value indicia 38*a* indicates "7 Points" (as would be typical for scoring a touchdown in football) while card rank scoring value indicia 38*c* indicates "No Points" (indicative of not scoring in a football game). Card rank scoring value indicia 38*b* indicates a sporting event score of "3 Points" (indicative of the scoring of a field goal in football).

The incorporation of the scoring value indicia 38*a*-38*c* as appropriately distributed throughout card set 30, therefore provides the mechanism for scoring the sporting event at the same time the poker game is being played. The distribution of scoring (as described in more detail below) is similar to and is representative of the frequency with which scoring may occur in an actual football game. In other words, the probabilities associated with drawing and accumulating cards with football scoring indicia on them is similar in many respects to the typical scoring frequency associated with the play of an actual football game. Therefore, the game method of play of the present invention simulates the play of the sporting event over multiple hands of play, as described above.

Figure 2B:
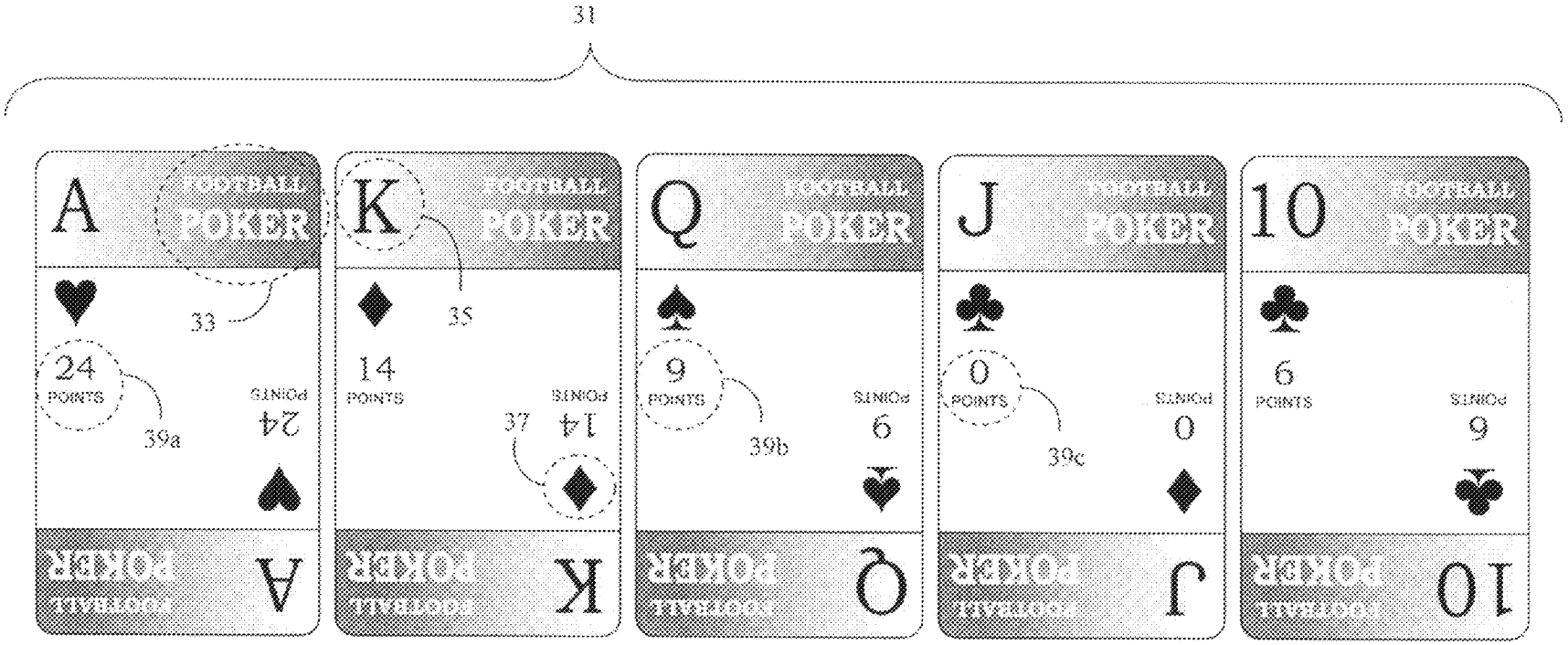
FIG. 2B is plan view of a first example (football poker) of a representative card set for a short version (single hand) embodiment of the game method of play of the present invention.

Reference is now made to FIG. 2B for a brief description of a first representative card set 30 for use in conjunction with a short (single hand) version of the game method of play of the present invention. FIG. 2B again provides a sample of the various cards utilized in conjunction with a "football poker" but this time for the short version embodiment of the present invention. The faces of the representative card set 30 therefore include indicia that specify a "total" or "final" score in each hand of play, anticipating only a single hand of play before the game is complete and a "winner" is determined.

Each of the cards in representative card set 31 bears the poker type indicia 33 to identify the type of poker to which this particular deck of cards is configured. In this case, the indicia "FOOTBALL POKER" is again provided on the face of each of the cards 31. In addition, card suit indicia 37 are placed on each of the cards, again varying according to the heart, spade, club, and diamond suit configurations typically used with the standard 52 card deck. Card rank indicia 35 are also provided as with the long version, again as typically provided on the cards of standard decks.

Once again, the primary distinctive indicia present on card set 31 are the various card rank scoring value indicia 39*a*-39*c* shown in FIG. 2B. These scoring value indicia 39*a*-39*c* are intended to provide the means for scoring the entire sporting event competition that is played at the same time the poker hand is played. In this case, card rank scoring value indicia 39*a* indicates "24 Points" (as would be typical for a "final" score in football) while card rank scoring value indicia 39*c* indicates "No Points" (again indicative of not scoring at all in a football game). Card rank scoring value indicia 39*b* indicates a sporting event score of "9 Points" (indicative of the scoring of three field goals, for example, in a full game of football).

The incorporation of the scoring value indicia 39*a*-39*c* as appropriately distributed throughout card set 31, therefore provides the mechanism for scoring the complete sporting event at the same time the poker game is being played. The distribution of scoring (as described in more detail below) is similar to and is representative of the frequency with which final scores might occur in an actual football game. In other words, the probabilities associated with drawing a single scoring card with football scoring indicia on them is similar in many respects to the typical scoring frequency associated with the play of an actual football game. Therefore, the game method of play of the present invention simulates the play of the sporting event in only a single hand of play, as described above.

Figure 2C:
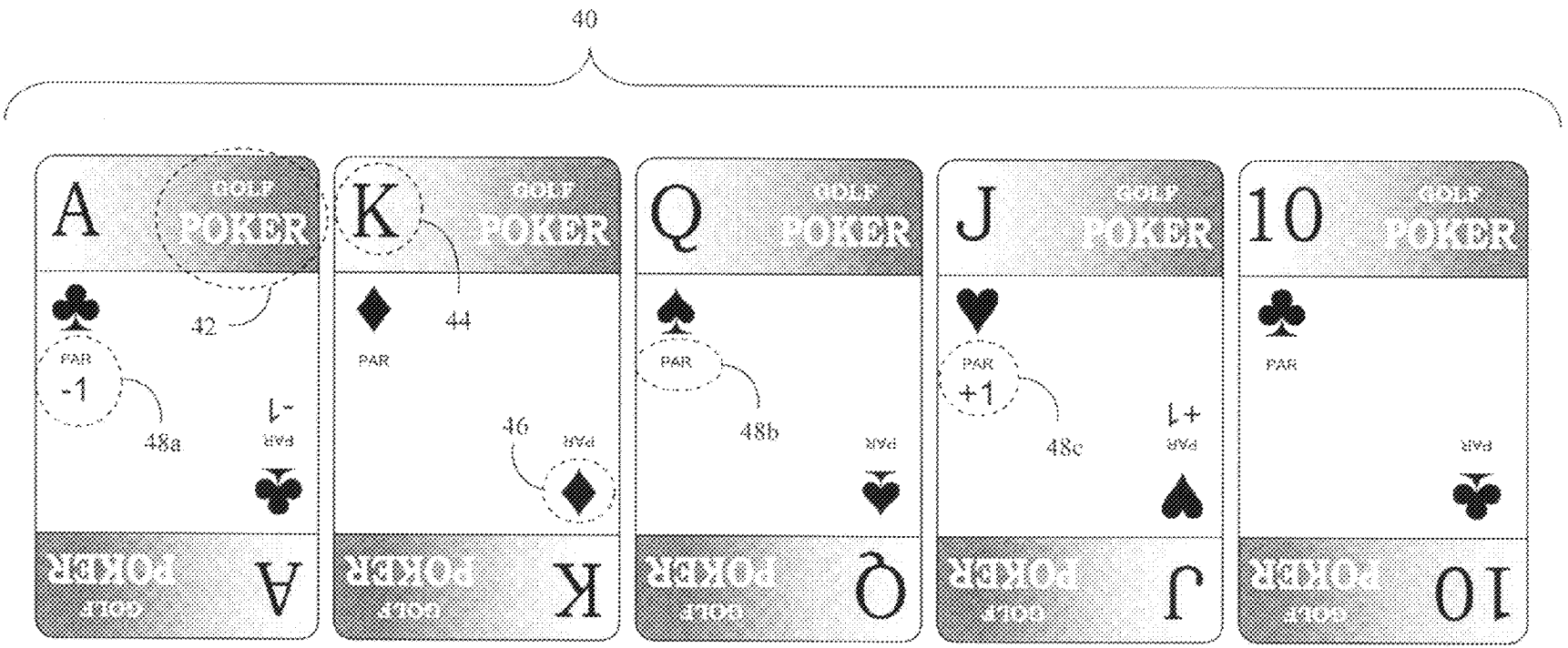
FIG. 2C is a plan view of a second example (golf poker) of a representative card set for a long version (multi-hand) embodiment of the game method of play of the present invention.

Reference is now made to FIG. 2C for a second example of a representative card set 40 this time in conjunction with the long version of "golf poker". The same types of indicia described above in conjunction with football poker are likewise utilized in the representative card set 40 for golf poker. These include the poker type indicia 42 (herein indicating "GOLF POKER"), the card ranking indicia 44, the card suit indicia 46, and the card rank scoring value indicia 48*a*-48*c*. In the game of golf, scores are accumulated typically by keeping track of golf strokes over or under par (or on par) during the game of golf. These various hole scores in golf are reflected in the variety of card rank scoring indicia 48*a*-48*c* shown in FIG. 2C.

Figure 2D:
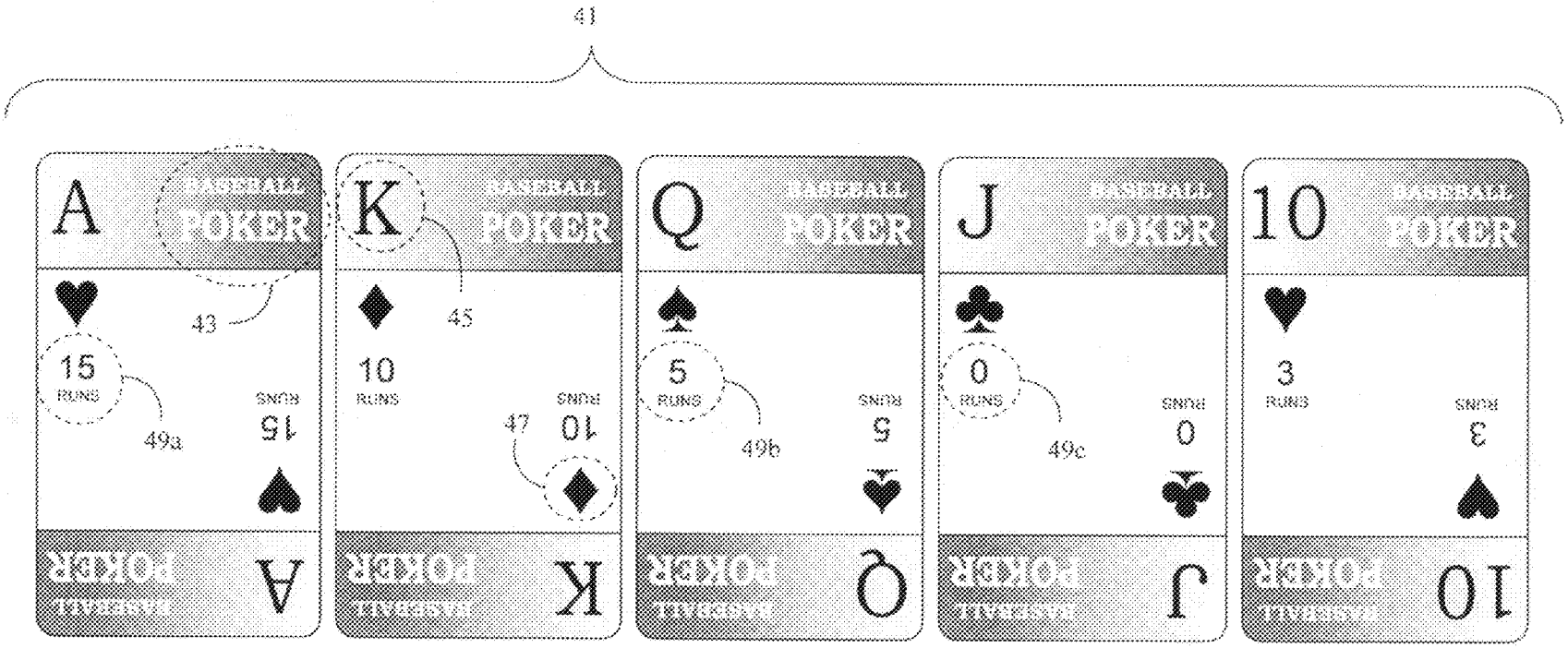
FIG. 2D is plan view of a second example (baseball poker) of a representative card set for a short version (single hand) embodiment of the game method of play of the present invention.
Figures 2E, 2F, 2G, 2H:
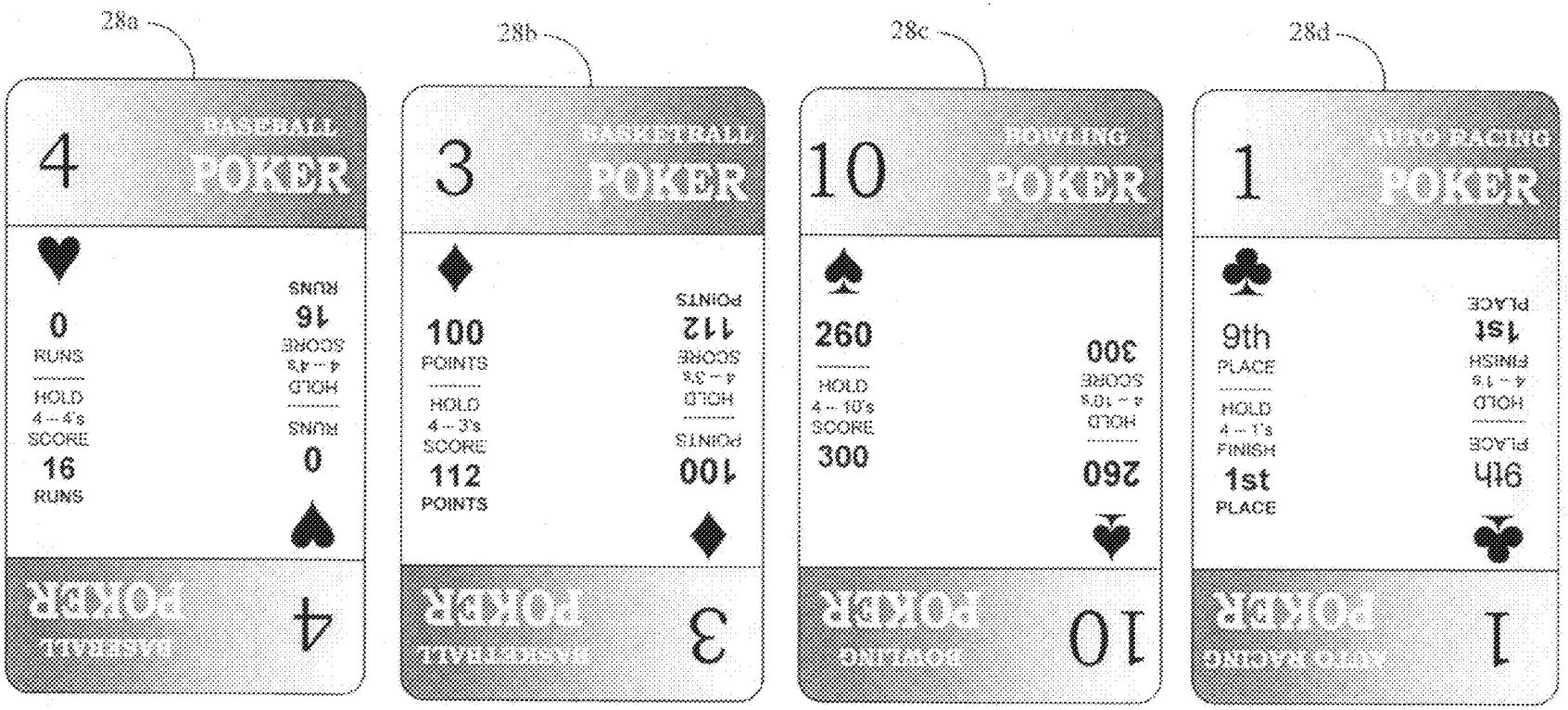
FIGS. 2E-2H are plan views of examples of unique "bonus" cards used in different short version (single hand) embodiments of the game method of play of the present invention.

FIG. 2D provides a further example of a typical card set used in another short version of the game method of play of the present invention. In this short version (single hand) game, card set 41 is used with "baseball poker" wherein the card rank scoring indicia 49*a*-49*c* are representative of the total or final score in a typical baseball game. It is understood, as described above, that in the short version, only one of the score values held by a player is used to determine the "winner" of the sport scoring part of the game.

The various other sporting event embodiments of the present invention each implement the same or a similar set of card face indicia as those shown in FIGS. 2A, 2B, 2C and 2D. The specific indicia are set forth in more detail on the rank value reference cards that are described below in conjunction with FIGS. 3A-3U. Although these rank value reference cards are more inclusive in the range of sporting events they cover, they also are not intended to be limiting of the variety of sporting event games that might be played in conjunction with the game method of play of the present invention. Other sporting events may be envisioned that would utilize similar rank value reference cards to assist with the play of the game. Likewise, the specific rank values identified on the rank value reference cards that are provided as examples, are not themselves the only rank values possible for a particular game. While the rank values should be reflective of the actual play of the sporting event, the rank values described herein are provided as examples only.

FIGS. 2E-2H provide examples of cards from alternate variations on some of the sports poker games (baseball poker, basketball poker, bowling poker, and auto racing poker, respectively) that may be used to add "bonus" features to standard scoring values associated with the short versions of the respective games. These "bonus" cards 28*a*-28*d* provide exceptional scoring mechanisms when, for example, four cards of a particular rank are held by a player. In baseball poker, for example, the "4" rank card 28*a* indicates that if the player holds all four of the "4" rank cards an exceptional scoring value of 16 runs is awarded (simulating, for example, hitting four grand slams in baseball). In similar fashion in bowling poker, the "10" rank card 28*c* indicates that if the player holds all four of the "10" rank cards an exceptional scoring value of 300 is awarded.

Reference is now made to FIGS. 3A-3U which provide preferred embodiment examples of both long version and short version rank value cards for ten different sports poker games. These rank value cards are shown in pairs for each type of sports poker involved. FIG. 3A for example showing the rank value card for the long version of football poker while FIG. 3B provides an example of a rank value card for the short version of football poker. In this manner the different scoring mechanisms between the long and short versions of each of the games (again provided only as examples herein) can be compared side by side.

Referring to FIG. 3A a typical rank value reference card 50 (in this case utilized in conjunction with the long version of football poker) is shown. One or more of these rank value reference cards 50 would be utilized in conjunction with the deck of cards to facilitate each player's understanding of the game and to guide the method of keeping score for the sporting event portion of the game. The representations of rank values on these rank value reference cards 50 duplicate the rank values individually indicated on the face of each of the cards in the deck. A "winner" in football poker comprises the player who has accumulated the best score (for purposes of collecting the pot) through a number of hands played during the course of the game.

A card rank 52 (in this case as an example, the "8" card) will have a rank value dependent upon the suit to which the rank belongs. Rank value 54 as an example in FIG. 3A has a value of "3" (the field goal in football poker) and in this case is associated with the Queen of spades. It should be noted that the majority of the cards in the deck for football poker, namely, each suit of the ranks 4 through Jack count no points on the sporting event portion of the game. Again, this is reflective of the frequency of scoring for the type of sport implemented in conjunction with the game.

FIG. 3B represents an example of a rank value reference card for the short version of football poker, this time with the card 51 showing the card ranks 53 and the associated rank values 55 as they would be indicative of the play of a full game of the sporting event.

Figure 3C:
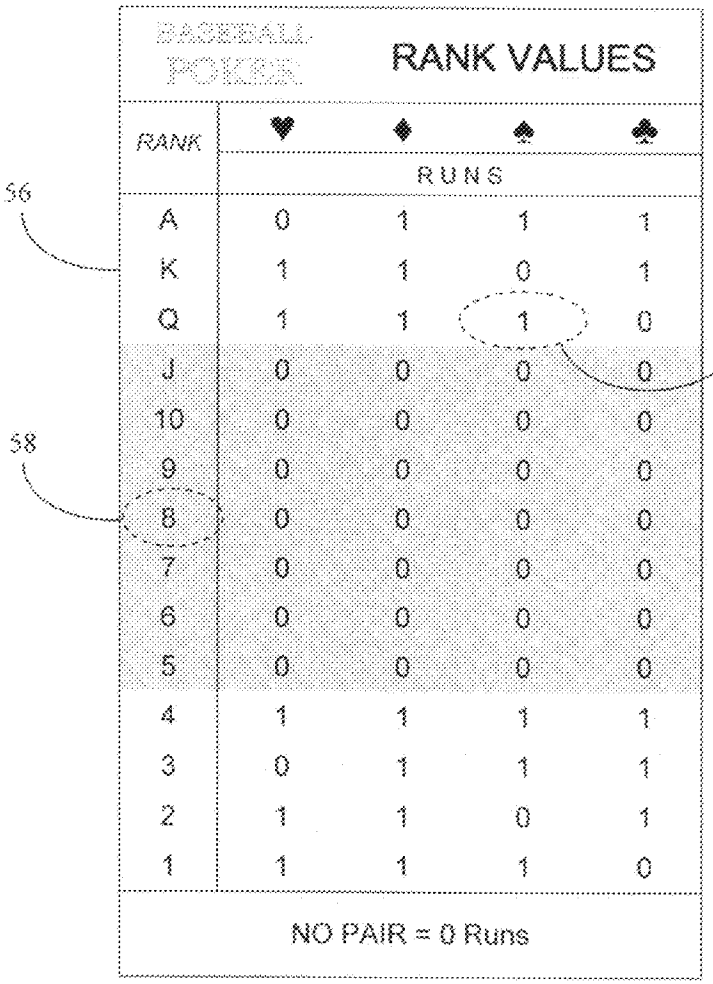
FIGS. 3A-3U are plan views of rank value reference cards for long and short versions (alternating in the figures) of a number of the various embodiments of the game method of play of the present invention.

FIG. 3C represents a second example of rank value reference card 56, in this case for use in conjunction with the long version of "baseball poker". Here again, rank indicia are provided (an example being rank indicia 58) and rank values are provided (an example being rank value 60) indicating one baseball run being scored when the player holds and plays the Queen of spades. A "winner" in baseball poker comprises the player who has accumulated the highest points score either in a hand (for purposes of collecting the pot in the short version) or through a number of hands played during the course of the long version of the game.

Figure 3D:
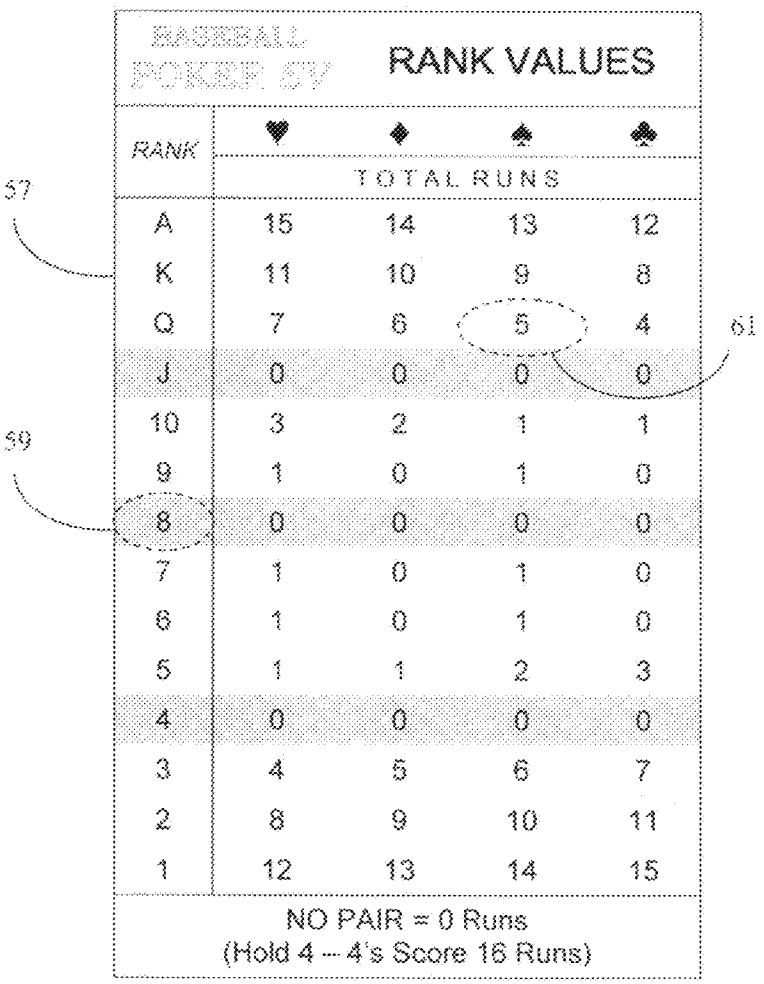

FIG. 3D represents an example of a rank value reference card for the short version of baseball poker, this time with the card 57 showing the card ranks 59 and the associated rank values 61 as they would be indicative of the play of a full game of the sporting event.

FIG. 3E represents a third example of rank value reference card 62 for use in conjunction with the long version of "basketball poker". Rank indicia 64 is shown and rank value 66, as an example, is shown providing 5 basketball points being scored when the player holds and plays the Queen of spades. A "winner" in basketball poker comprises the player who has accumulated the highest points score either in a hand (for purposes of collecting the pot in the short version) or through a number of hands played during the course of the long version of the game.

FIG. 3F represents an example of a rank value reference card for the short version of basketball poker, this time with the card 63 showing the card ranks 65 and the associated rank values 67 as they would be indicative of the play of a full game of the sporting event.

FIG. 3G shows a rank value reference card 68 for the long version of "golf poker", again providing rank indicia 70 as an example and rank value 72 as an example. In golf, rank value 72 represents "par" which is the sporting event value for the Queen of spades in golf poker. The "winner" in golf poker comprises the player who has accumulated the lowest score based on the over and under par (as well as par) indications on the cards held through each hand. Reference in this case is made to the par value for a particular hole (a hand of poker) as indicated on the score card for the game.

FIG. 3H represents an example of a rank value reference card for the short version of golf poker, this time with the card 69 showing the card ranks 71 and the associated rank values 73 as they would be indicative of the play of a full game of the sporting event.

FIG. 3I shows a rank value reference card 74 for the long version of "bowling poker". Rank indicia 76 are provided. Rank value indicia 78 are also provided. In this case rank value 78 represents a pin count of 9/1 in a frame of bowling. "ST" in FIG. 3I represents a strike or 10 pin count (plus bonus pins) in bowling. A "winner" in bowling poker comprises the player who has accumulated the highest pin count score (for purposes of collecting the pot in the short version) or through a number of hands played during the course of the long version of the game.

FIG. 3J represents an example of a rank value reference card for the short version of bowling poker, this time with the card 75 showing the card ranks 77 and the associated rank values 79 as they would be indicative of the play of a full game of the sporting event.

FIG. 3K shows an example of a rank value reference card 80 for use in conjunction with the long version of "darts poker". In this case rank value 84 represents 18 points scored in darts as the scoring indicia placed on the Queen of spades. A "winner" in darts poker comprises the player who has accumulated the best points score either in a hand (for purposes of collecting the pot in the short version) or through a number of hands played during the course of the long version of the game.

FIG. 3L represents an example of a rank value reference card for the short version of darts poker, this time with the card 81 showing the card ranks 83 and the associated rank values 85 as they would be indicative of the play of a full game of the sporting event.

Figure 3N:
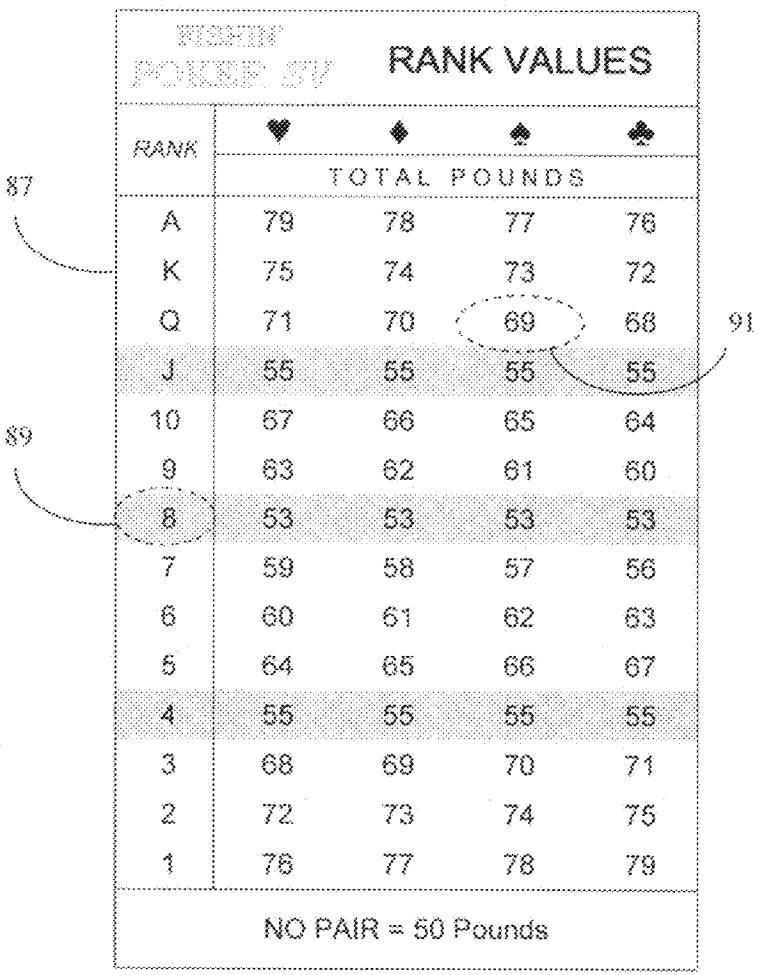
Figure 3M:
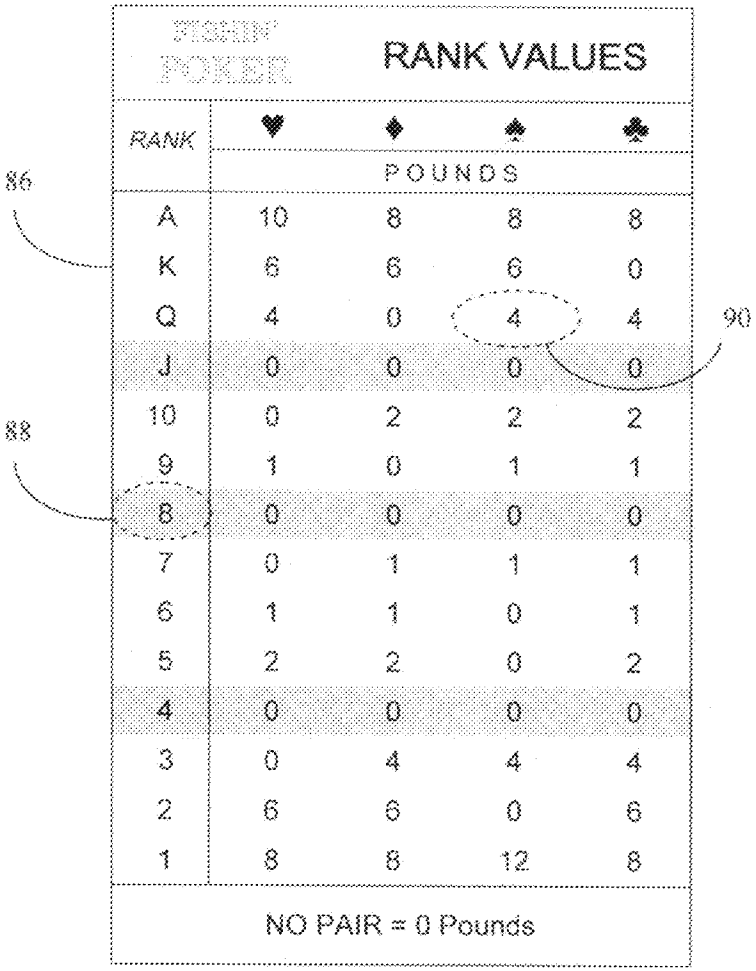

FIG. 3M shows a rank value reference card 86 for use in conjunction with the long version of "fishing poker". In this case, rank value indicia 90 provides "four pounds" as a scoring value in the fishing poker game. A "winner" in fishing poker comprises the player who has accumulated the best pounds score either in a hand (for purposes of collecting the pot in the short version) or through a number of hands played during the course of the long version of the game.

FIG. 3N represents an example of a rank value reference card for the short version of fishing poker, this time with the card 87 showing the card ranks 89 and the associated rank values 91 as they would be indicative of the play of a full game of the sporting event.

FIG. 3P shows a representative rank value reference card 92 for use in conjunction with the long version of "deer hunting poker" wherein rank value 96 for the Queen of spades is "2 points" referring to the number of "points" on the deer rack or antlers (the most prized deer have more points on their antlers). Various other cards in this deer hunting poker deck represent values such as "1 point" or "3 points" on the deer rack or a "miss" indicating that no deer was hit. A "winner" in deer hunting poker comprises the player who has accumulated the best points score either in a hand (for purposes of collecting the pot in the short version) or through a number of hands played during the course of the long version of the game. It may be preferred in deer hunting poker, to provide different scoring approaches and even different rank values in the multi-hand play of the game versus the short or single hand version. In the multi-hand version (as represented by the rank value reference card shown in FIG. 3P) scoring would be the result of cumulative points from all qualifying cards (as defined below) throughout the hands played to yield a score total. As shown in FIG. 3Q a short version of the game method (a single hand played per game) will have higher individual rank values on the cards with the player's score coming from the single best qualifying card that is held. This approach to scoring may be incorporated into other variations of the game method of play when the sporting event lends itself to this short game versus long game distinction or if it is the preferred method in certain settings (such as with casino table play) as described in more detail below.

As such, the short version of deer hunting poker uses rank value card 93 which bears card ranks 95 and the associated rank values 97, again the values being indicative of total rack points on a deer.

FIG. 3R shows a rank value reference card 98 for the long version of "horse racing poker" wherein the rank values 102 are represented in seconds. In this embodiment the rank values range from 11 to 14 seconds and include $11^5$ (eleven and one-half) as shown. The "winner" in this case comprises the player who has accumulated the fewest seconds during the play of the game through a series of hands, played during the course of the game. Reference is made to the display mechanism and methodology associated with racing events, described in more detail below, that more clearly indicates the winner of a racing type game.

FIG. 3S represents an example of a rank value reference card for the short version of horse racing poker, this time with the card 99 showing the card ranks 101 and the associated rank values 103 as they would be indicative of the play of a full game (race) of the sporting event. In this case the rank values represent the finishing position (or a scratch from the race) for the complete race rather than some accumulation of seconds.

FIG. 3T provides an example of a rank value reference card 104 for use in conjunction with the long version of "auto racing poker". In this embodiment the rank values represent miles where rank value 108 represents 30 miles (again, the Queen of spades scoring value). The miles accumulate during the play of the game, and in this instance, can include negative numbers that actually slow down the "racer" in the competition. The "winner" in this case comprises the player who first reaches a designated number of miles (race length of 300, 400, 500 miles, for example) during the play of the game through a series of hands played during the course of the game. Reference is made to the display mechanism and methodology associated with racing events, described in more detail below, that more clearly indicates the winner of a racing type game.

Finally, FIG. 3U represents an example of a rank value reference card for the short version of auto racing poker, this time with the card 105 showing the card ranks 107 and the associated rank values 109 as they would be indicative of the play of a full game (race) of the sporting event. As with horse racing poker, these rank values for the short version of the game constitute finishing positions (or out of the race events) to reflect the results of an entire race in one hand of play.

As indicated above, the utilization of scoring points and various other rank values are closely tied to the specific sporting event being played in conjunction with the game of poker. The representations shown in FIGS. 3A-3U are generally intended to reflect the probabilistic occurrences of the various scores or actions as they might typically occur in the actual play of the sporting event. The random distribution of the individual cards during the play of the present game thereby bring these scoring rank values up in a manner similar to the frequency with which such scores or actions occur in the actual sporting event (either incrementally for the long versions of the games or in total for the short versions of the games). The distribution of these scoring values, therefore, is an important aspect of the present invention, as these distributions allow for a close approximation of the scoring typically occurring in the sporting event over the progress of a reasonable number (eight, as an example) of poker hands being played. In other words, with football poker, for example, the play of eight hands of poker (in the long version) in conjunction with the scorekeeping associated with the rank value indicia, should result in an overall sporting event score similar to such scores as actually occur in games of football competitively played for the time duration according to football rules. Similar distributions are designed into the scoring, rank value numbers, and actions indicated, on the balance of the games described herein, and are likewise anticipated in the variety of additional sporting event games similar in their manner of scoring to those games specifically described as examples herein.

Reference is now made to FIGS. 4A-4D for a number of examples of score cards utilized in conjunction with the game method of play of the present invention. As indicated above, the game progresses through a combination of the play of poker hands and the tracking of sporting event scores and actions that occur based upon the poker and scoring values assembled and held by the players. While betting proceeds using tokens as indicated above (thereby keeping score of the progress of poker winnings by the accumulation of tokens or chips) some other mechanism is necessary to track the progress of the game with respect to the sporting event scores. Therefore, in multiple hand embodiments, a variety of score cards are utilized in order to record the sporting event scoring during progressive hands of the game method of play.

Figure 4B:
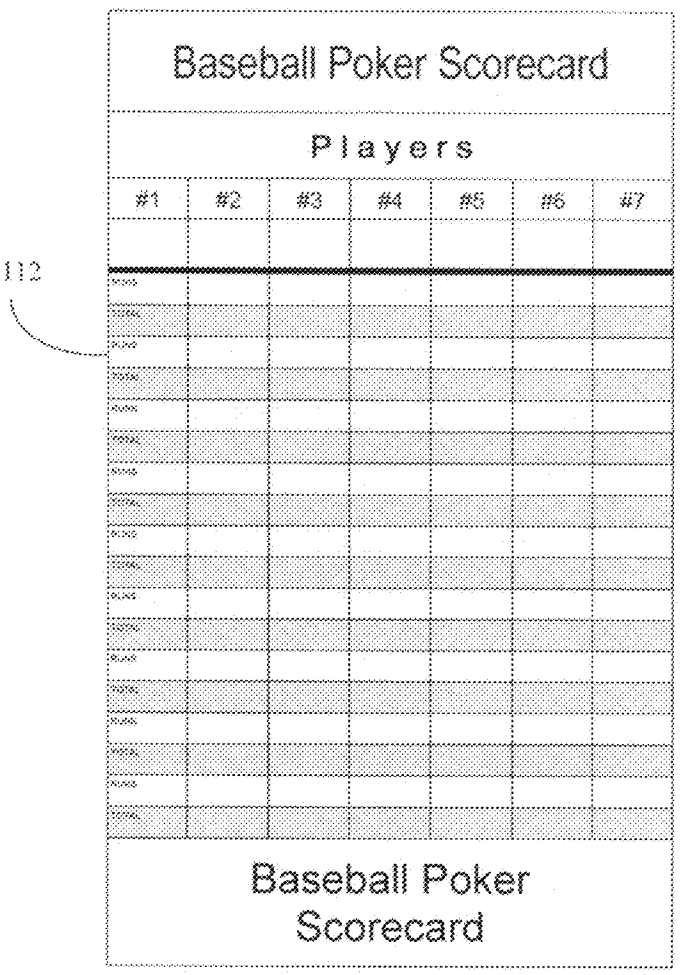
FIGS. 4A-4D are plan views of score cards for a number of the various embodiments of the game method of play of the present invention.
Figure 4A:
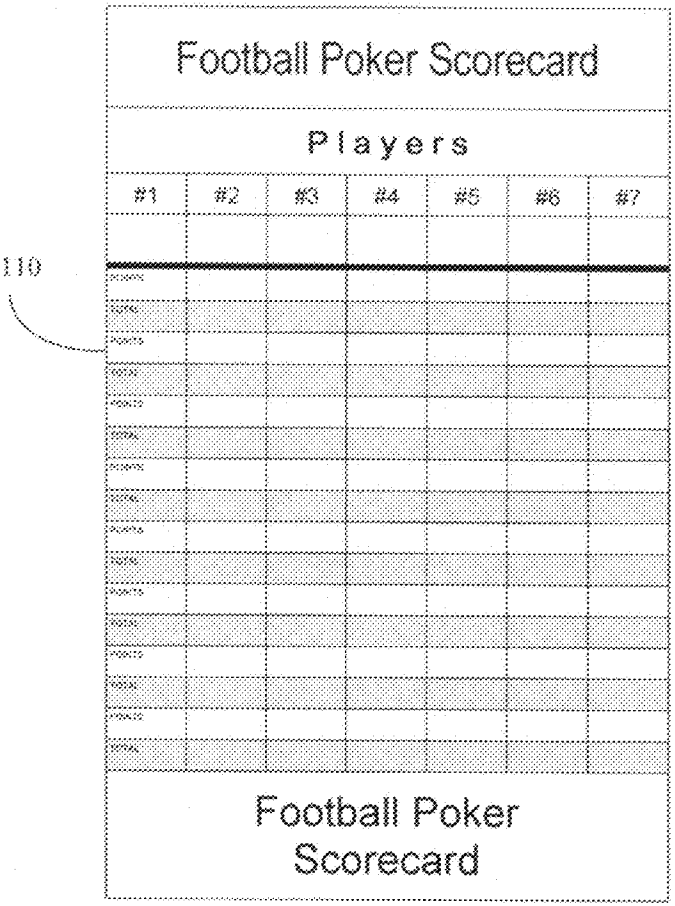

FIG. 4A represents a football poker score card 110 which includes rows for up to eight hands of the sports poker game and up to seven different players. A column is provided for each of the seven players to indicate points accumulated in a particular hand and the total accumulated points through all hands played. In similar fashion, FIG. 4B represents a baseball poker score card 112, with nine hands (representing nine innings) of sports poker being played and up to seven different players participating. Runs scored based upon the indicia on the cards accumulated and held, are indicated as well as running totals of these scores.

Figure 4C:
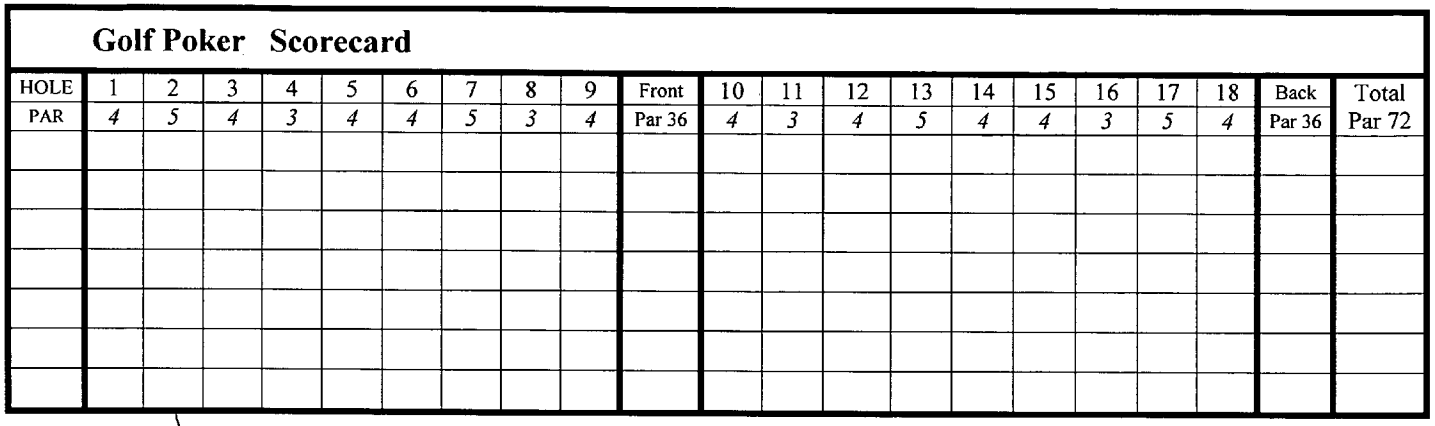
Figure 4D:
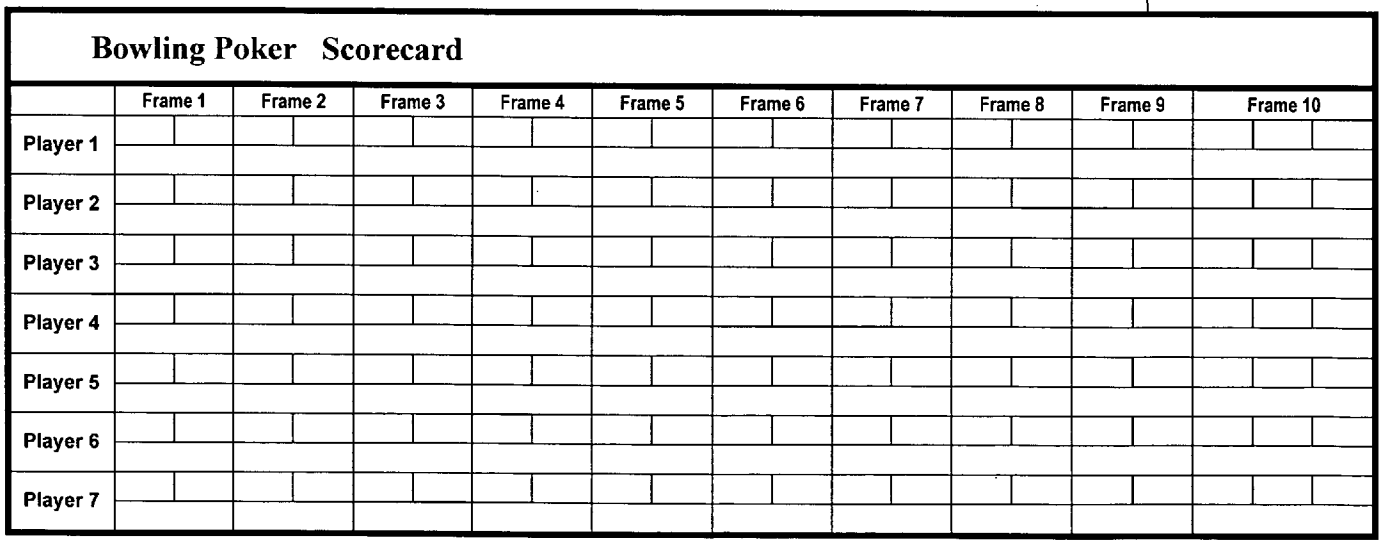

FIG. 4C provides a similar score card 114 utilized in conjunction with golf poker. FIG. 4D represents a score card 116 utilized in conjunction with bowling poker. In the case of golf poker, the score card also bears the number of strokes for each hole (hand) that constitutes par. In the case of bowling poker, space is provided to enter the first and second "balls rolled" according to the card indicia as described above.

Figure 4E:
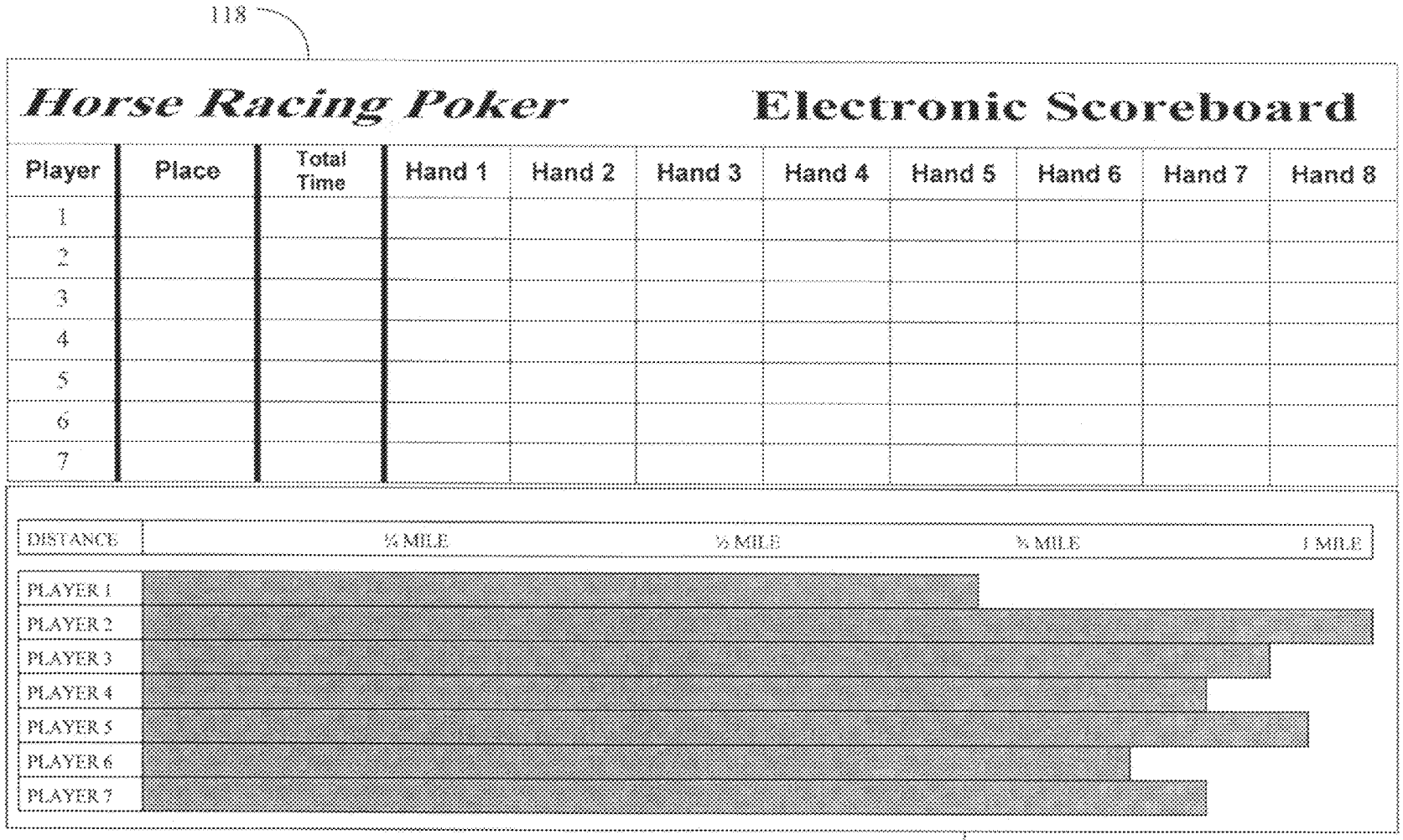
FIG. 4E is a partially schematic view of a combination electronic scoreboard and game progress display device associated with a number of the various "racing" game embodiments of the present invention.

FIG. 4E discloses a score card or score board 118 as may be utilized in conjunction with a sporting event in the nature of a head to head race between participants. Score card 118 may be a piece of paper that is written upon (as in the above described embodiments) or it may be a display device positioned in a visible area in association with the players participating. The reason for this variation in conjunction with racing type sporting events is the beneficial graphic display applicable to racing that shows the head to head progress of the players as if actually moving down a racetrack. This electronic visual display 120 provides a racing progress such as might be viewed by an audience in an actual racing event. Thus the configuration for an electronic scoreboard and an electronic display as shown in FIG. 4E might equally be applicable to an auto racing poker embodiment of the present invention. Of course, other embodiments that include head to head progress between players in an actual sporting event might similarly be reflected in the configuration shown in FIG. 4E with variations according to the specific game rules of play for the sporting event.

Figure 5A:
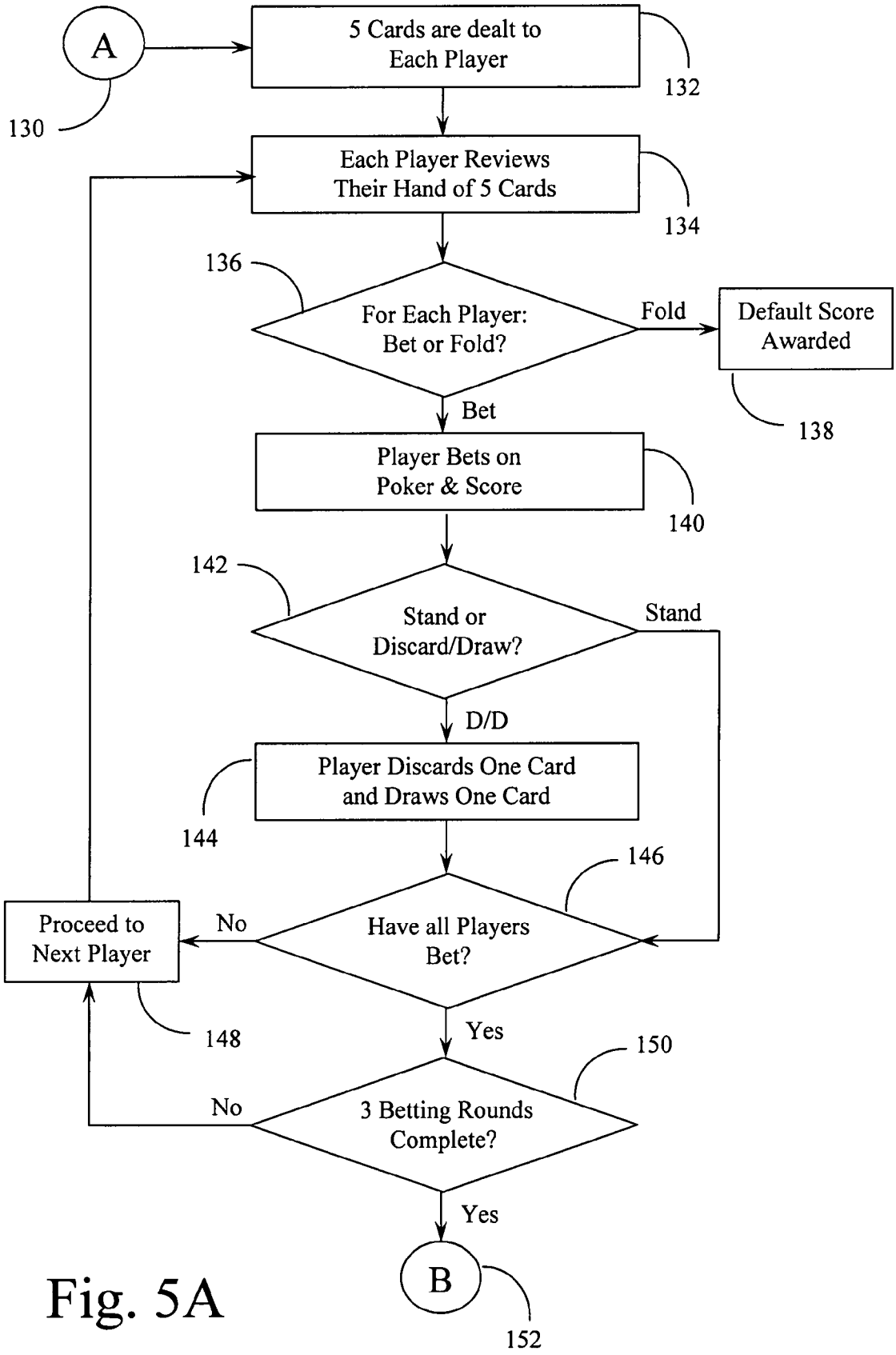
FIGS. 5A & 5B are flowcharts of the broad level methodology of the game method of play of the present invention.
Figure 5B:
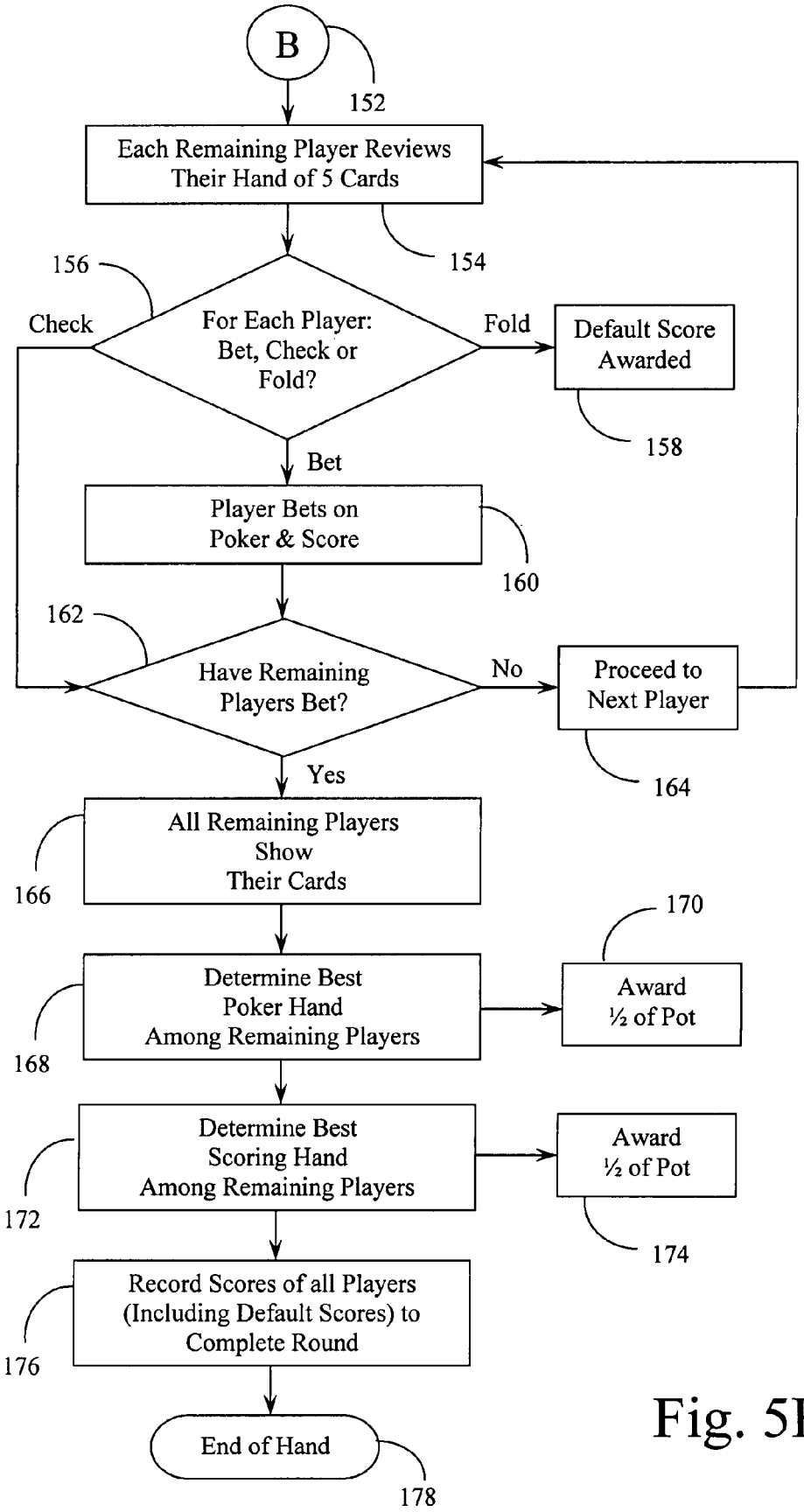

Reference is now made to FIGS. 5A & 5B for a detailed description of the general method of play steps that comprise the present invention. In FIG. 5A, Step 130 provides for the initiation of the game among the various players involved. It should be noted that the example shown in FIGS. 5A & 5B includes poker rules based upon five card poker games and that simple modifications to the method could be implemented in conjunction with other types of poker games (such as seven card poker games).

Step 132 shown in FIG. 5A involves dealing five cards to each of the players in the game. Step 134 follows wherein each of the players reviews their hand of five cards. Each player in turn must decide to either fold or bet. If a player chooses to fold, then at Step 138 the player may be awarded a default score which is recorded on the score card. If a player chooses to bet, then at Step 140 the player bets on the combined strength of the poker hand and the sporting event score they believe they will accumulate and retain.

After betting, each player at Step 142 must then to decide to stand on the five cards in his or her hand or discard and draw cards in an attempt to achieve a better poker or sporting event hand. If the player chooses to discard and draw a card, then at Step 144 that player is permitted to discard one card and to draw one card from the remaining cards in the deck (to take the top card). Although carried out in the manner similar to standard poker, the player in the present game method of play is limited to discarding one card and drawing one card (from the top) of the remaining cards. Additional rounds in this first part of the game will permit the player to exchange additional cards or to re-exchange a card previously drawn.

At Step 146 a determination is made whether all the players have bet (or folded), and if not, the method proceeds to the next player at Step 148 where the cycle of betting, folding, standing, or discarding and drawing is carried out. If all players have bet (Step 146) in a round, it is determined whether three betting rounds have been completed at Step 150. If not, again the method proceeds to the next player at Step 148 and the cycle is repeated until all of the players have had the opportunity to bet three times and the option to discard one/draw one three times. If all players have completed three rounds, then the game method progresses through Step 152 which is an off page connector to the method continuing in FIG. 5B.

After the first portion of the play of the game shown in FIG. 5A, namely the three rounds of initial bets, discarding, and drawing, each of the remaining players reviews their hands of five cards at Step 154. For each of the remaining players, a decision is made to fold, check, or bet further. If at this stage of the game the player decides to fold, a default score may be awarded at Step 148. If at Step 156 the player decides to bet, then at Step 160 the player bets on the outcome of their poker hand and the sporting event scores that are reflected on the cards included in their poker hand. Then as before, a determination is made if all of the remaining players have bet at Step 162. If not, the betting proceeds to the next player at Step 164. This process is repeated until each player has had the opportunity to bet, check, raise, or eventually call to bring the betting to a close. If this occurs and all remaining players have had the opportunity to bet at Step 162, then at Step 166 all the remaining players show their cards.

At Step 168 a determination is made of the best poker hand among the remaining players. At Step 170 that player is awarded one-half of the pot of bets accumulated. Then at Step 172 a determination is made of the best sporting event scoring hand among the remaining players. That player, at Step 174 is awarded the remaining half of the pot of bets accumulated. Finally, at Step 176 a record is made of all the scores of the players, including default scores, to complete the round. As indicated above in conjunction with the score cards, an entire game may involve multiple rounds, or a single round, depending upon the method of scoring, the sporting event, and the typical accumulation of scoring values used to simulate the actual play of that sporting event game. Finally, at Step 178 the end of the hand is achieved and a new hand is carried out, again according to the score card arrangements for the particular sporting event utilized in conjunction with the poker game. In the short version (single hand) of the game method of play, this step results in completion of the game.

The various method steps identified in FIGS. 5A & 5B are intended to be generic to the variety of games that can be implemented in conjunction with the basic concepts of the present invention. A variety of specific rules associated with specific sporting events and specific types of poker being played in conjunction with the present invention are described in more detail below. In general, however, those skilled in the art will recognize that with the basic game method of play described above, a variety of implementations of the present invention can be carried out.

Figure 6:
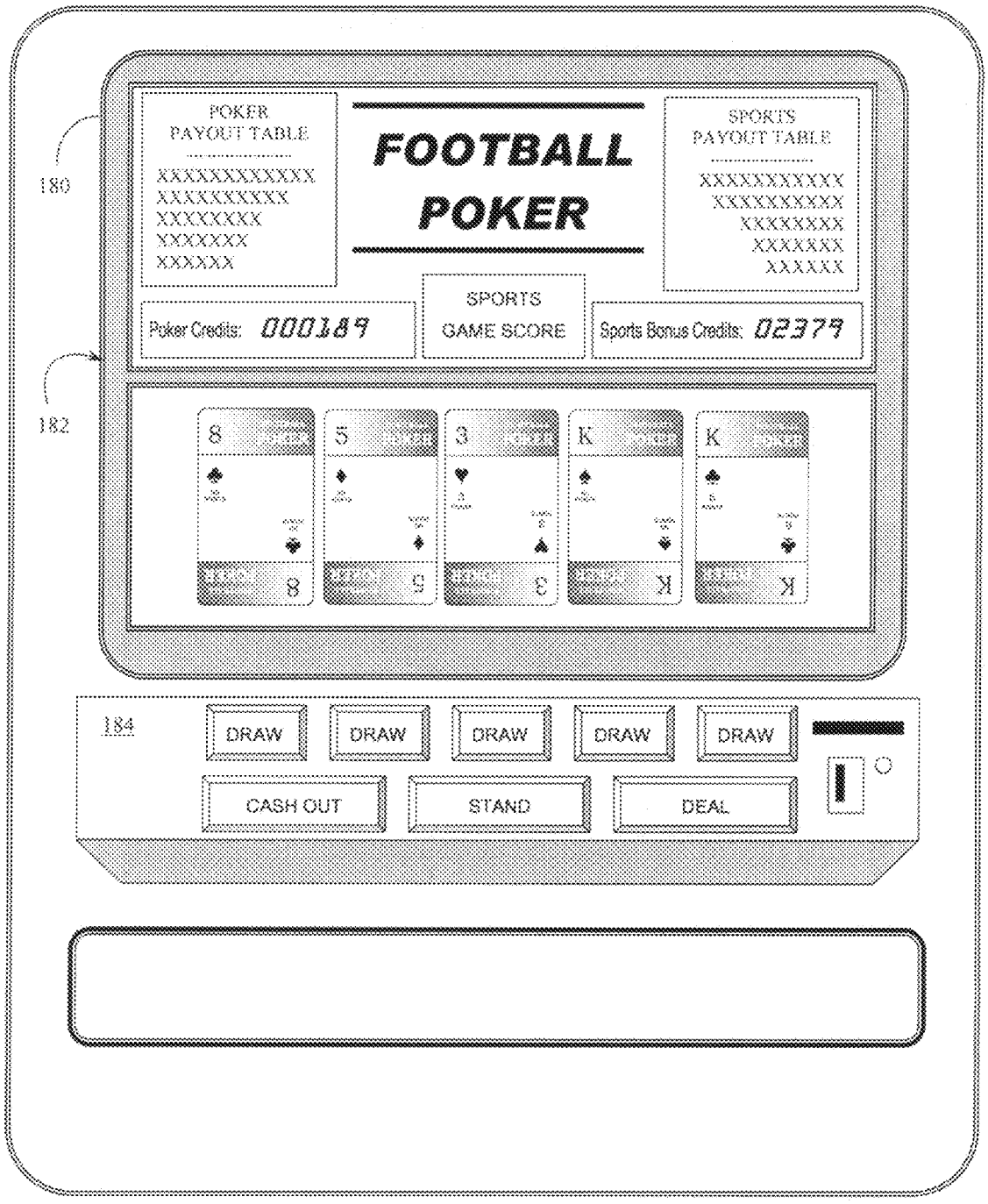
FIG. 6 is a front view of a representative implementation of the game method of play of the present invention in a video gaming environment.

As indicated above, in addition to variations in the sporting events that are simulated in the game method of play of the present invention, various gaming environments may also provide alternative embodiments. FIG. 6 represents an example of one such alternative embodiment wherein the game method of play is implemented in conjunction with a video gaming machine 180. In this case, a video display 182 is positioned within gaming machine 180, as well as an array of user input controls 184, all of which are similar to systems currently in place in the video gaming environment. As implicitly shown in FIG. 6, the programming associated with the computer system that generates the display and controls the play of the game is intended to reflect the same probabilities of random occurrences that are reflected in the parlor game embodiment described above. In this case, an example is given of a five card poker hand utilized in conjunction with football poker. Input controls 184 allow the user to draw (and inherently discard, as well) one of the five cards shown in the display 182. Scoring is provided at the top display 182 both in conjunction with poker credits and sports bonus credits. The sports game score is also provided in the middle of the display as shown.

The payout in this video game play environment is again based on probabilities as is typically associated with video poker, slots, and the like. Unlike a direct competition between players, the video/slot gaming environment requires payoffs to be based upon probabilities associated with poker hands (and therefore the sporting event scoring values) that a player accumulates during the individual play of the game. The progress of the game in a video environment is essentially the same as that in a parlor game environment, although only one player progresses through the various stages of betting, discarding, and drawing cards. Numerous variations on the number of hands to be played and/or the manner of providing a player with the opportunity to cash out at any of a number of points during the play of the game are anticipated.

Figure 7:
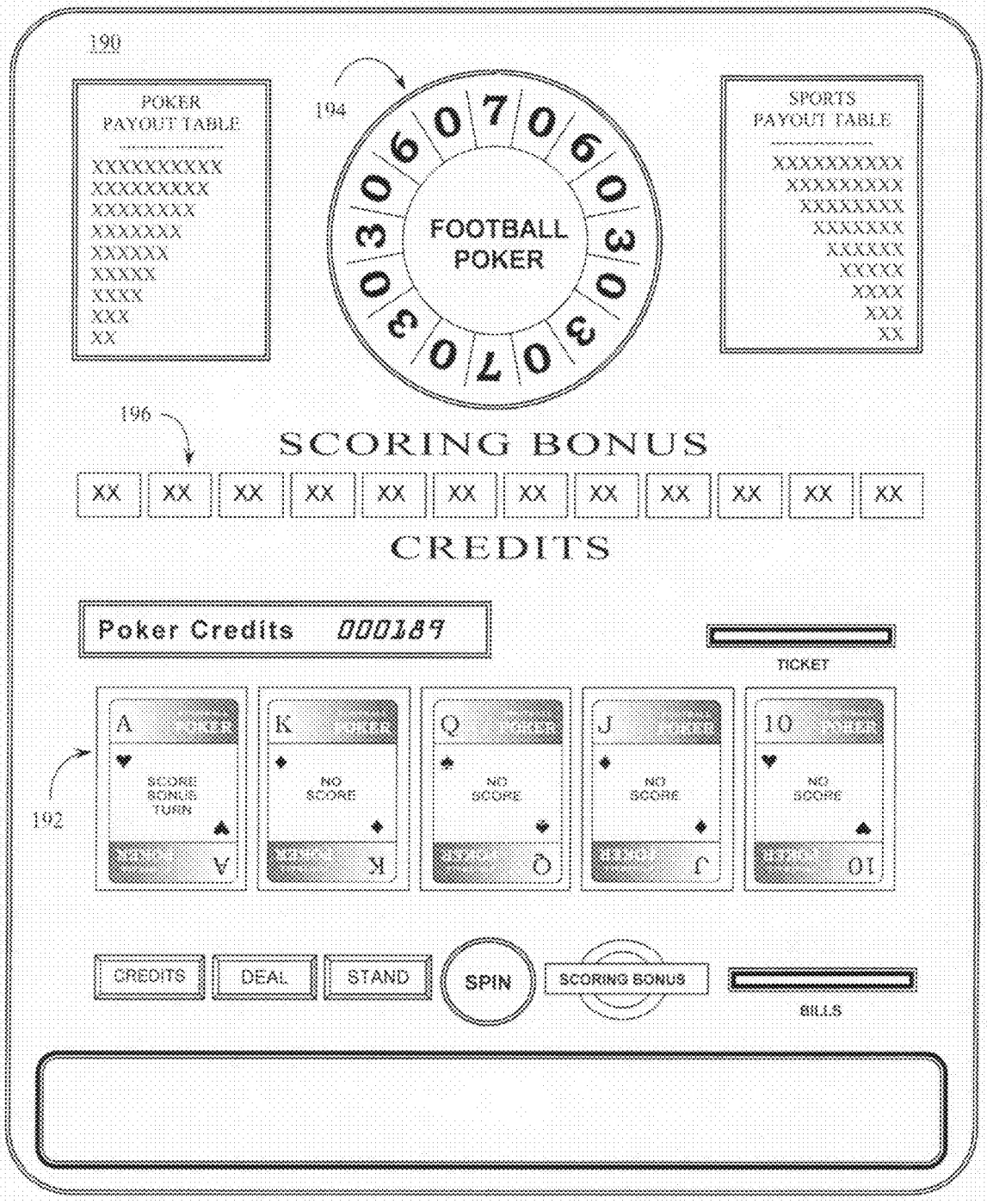
FIG. 7 is a front view of a representative implementation of the game method of play of the present invention in a slot machine gaming environment.

FIG. 7 represents an example of a further alternative embodiment wherein the game method of play is implemented in conjunction with a slot machine 190. This embodiment is similar in some respects to the video gaming embodiment shown in FIG. 6 with the primary difference being the use of a bonus wheel 194 that is spun by the player when a "score bonus turn" (or the like) turns up on one of the cards 192 received during the "hand" played. The cards 192 in this embodiment incorporate the poker indicia as in other embodiments but do not carry the specific scoring indicia, relying instead on the bonus wheel 194 to assign the scoring value. On each play of the machine (a hand of poker) there is a possibility of a score indicator appearing on a card that is dealt. When this occurs lights are illuminated to notify the player who then has the opportunity to push the "SPIN" button to achieve a score. The scores indicated on the wheel 194 will again be appropriate to the type of poker being played (such as 7, 6, and 3 for football poker). The player pushes the "SCORING BONUS" button which activates the LCD Scoring Bonus panel 196 under the scoring wheel 194. The LCD lights up individual panels one at a time rapidly, moving back and forth across the panel 196 before stopping (randomly programmed) on a bonus value that indicates the score achieved and the credits won. The bonus turns may be controlled by the score value. For example (in football poker) if the wheel lands on 7 points the player receives three additional bonus turns; if the wheel lands on 6 points, two additional bonus turns; 3 points, one additional bonus turn; and if the wheel lands on 0 points, no additional bonus turns. This multiple bonus system may, of course, be adapted to the play of any of the sports poker games of the present invention.

Detailed Description of a Number of Variations on the Preferred Embodiment

As indicated above, individual sports simulation games in the present invention may include, but are not limited to, auto racing, baseball, basketball, bowling, darts, football, golf, hockey, horse racing, pool, soccer, fishing, hunting, and many others.

The use a single deck of 56 cards is the preferred embodiment, including the addition of the rank of "1" in each of the four suits (in the deck of 56). Only "qualifying" cards can provide score values for the sporting event simulation part of the game. "Qualifying" cards are cards used by a player to assemble a poker hand. For example, a pair of Kings as poker hand equals a pair of Kings as "qualifying" cards (scoring cards). Scores from all other (non-qualifying) cards are ignored. In the preferred embodiment of the game, a player must hold a pair, or better to score. That is, a high card poker hand can not score in the preferred method of play. Depending on the sporting event being simulated (the specific game being played), a default score may be awarded to a player that has no "qualifying" cards and therefore would have no score. If all players have "no score" or non-qualifying hands, or have tied for best score, scoring bets may push or stay in the betting pot for the next hand. The rank of Ace in the preferred embodiments is always high, 1 is always low (as a poker rank). In addition, an Ace and a 1 can not be used together to form a straight in a poker hand.

In one embodiment (the home version or "parlor" game), a plurality of sport specific scorecards are preferably incorporated in the games. Various casino versions (table games), may use an electronic large screen sport specific scoreboard to show cumulative player scores or relative positions (first to last) in a simulated sport competition. Specific features on these displays and on the game tables may be included that relate to table layout, multiple bets (poker and sport score), "player only pots", sequence of play, preferred betting, single and multiple hand versions, banking versions, non-banking ("rake") versions, etc.

The preferred embodiment includes the use of three "discard one/draw one" play options on each hand, with one option per player per turn, although the scoring method is adaptable to any variety of poker type games including stud poker, draw poker, blackjack, 3 card poker, "hold-em", pai-gow, etc. The scoring method is adaptable to electronic devices such as slots, video games, hand held games, etc. (single or multiple hands). The simulated sporting events can be played as a series of games as in a championship competition.

Some variations are applicable to the "Home Version" or parlor game environment. In such an environment, depending on the game played, play continues for a set number of hands or until a predetermined score is reached. As described above, each hand is played for best poker and best score. In a wagering game, the pot splits on each hand between best poker hand and best scoring hand. In one variation of the game all players ante one token prior to the dealing of the cards. Then, beginning to the dealers left and ending with the dealer, all players receive five cards face down. The play then continues as described above with regard to FIGS. 5A & 5B. In the final round of betting, beginning again with the player at the dealer's left, and at each player's option, any bet up to a maximum set by the players, can be made. The number of raise limits may also be set by the players prior to starting the game. Unless they fold, all players will have the opportunity to match (call) the bet(s) up to the predetermined limits at each betting interval.

In the long version (multi-hand) method of play, if the best score is tied on a hand, the "score" half of pot is left in and carries over to the next hand. If best score ties on the last hand of the game (no carry over possible), the tied player with the best poker hand wins the "score" half of the pot from the last hand. If the total score for the game is tied after the last hand, tied players only play additional hand(s), without wagering, until best score from tie breaking hand(s) decides a winner. "Side pots" are possible and must be determined prior to the beginning of the game and winnings from side pots are generally distributed at the end of the game.

Some further variations are applicable to the "Casino Version" or casino game environment. In such environments there may be "One Hand Games" where no scorecard is needed and the play is for both poker and a single score outcome (and wager settlement). These One Hand Casino Games may include:

(a) A "Bank Version" where the house participates as any other player for both poker and score values. In such a gaming environment, players make one bet for each outcome (poker and score) in appropriate betting positions on the table before the cards are dealt. The house fixes a minimum and maximum bet for that particular table. Players compete individually against the house in a manner similar to blackjack, pai-gow, etc. The house waits to play (draw cards) until all players have completed the draw part of the game play. The house then turns its five cards up and has the same three optional draws as each of the players. When the house has completed its hand, the remaining players then turn their cards face up and settlements are made. If the house has the best poker hand, the house takes the poker bets (which may be segregated in this version of the game) from the players. If the house has the best scoring hand, the house takes the scoring bets (again, which may be segregated) from the players. If one or more of the players beat the house (poker and/or score) those players are paid according to a payout schedule established by house. If the house and a player have the same score (ties), the scoring bet pushes. To increase the enticement of the game, and draw more play, a "Players Only" pot could be used where the player (not the house) with the winning score would receive the "Players Only" pot.

(b) A "Non-Bank Version" where the house takes a "rake" and does not play, i.e. the game is player versus player only. This method requires two to seven players (maximum) using a single deck of 56 cards. In one embodiment of this version of the game, players make two bets, one each for poker and score, in specified areas on the table, prior to cards being dealt. After each player places bets, the house collects a rake (or a rake taken from the wagers). The dealer deals five cards per player face down and each of the players receive the three "discard 1/draw 1" options as described above. After all players have had the three discard 1/draw 1 options, the hand is over. Each player then places their cards face up on the table and the house determines which player holds the best poker hand. That player then receives all poker wagers from the other players. The house then determines the player with the best scoring hand and that player receives all scoring wagers from the other players. If two or more players tie for best score, tied player with best poker hand wins the scoring wagers.

Figure 8:
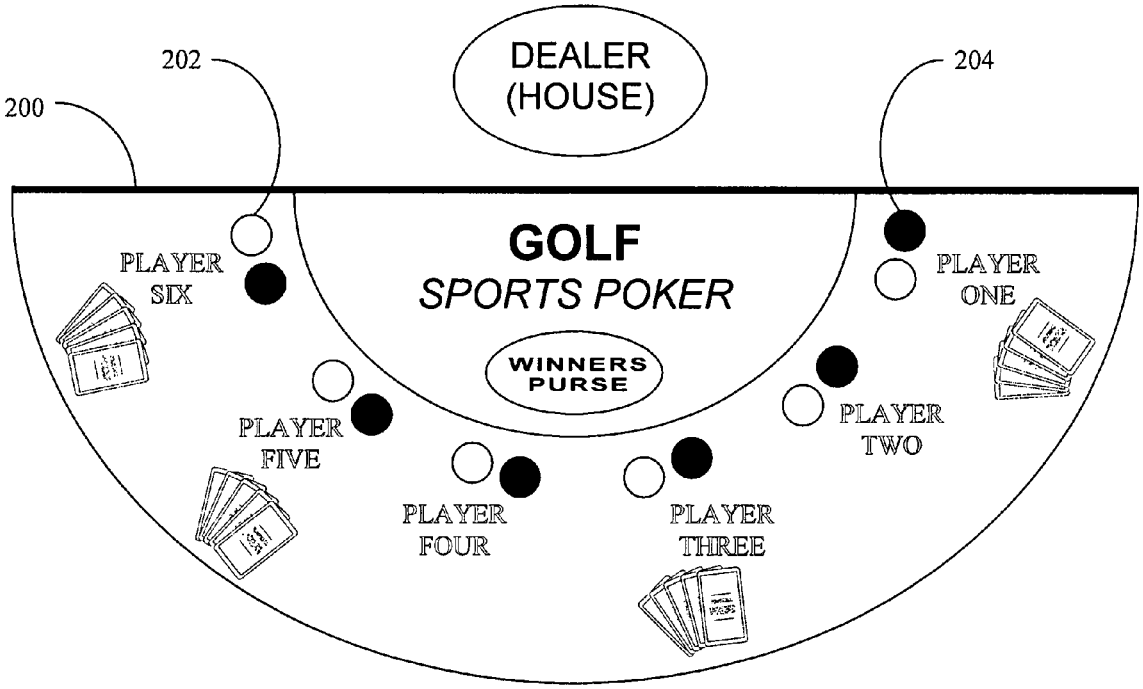
FIG. 8 is a top plan view of a casino poker table configuration appropriate for implementation of the game method of play of the present invention in a casino gaming environment.

The above described single hand casino games may be facilitated with the use of a casino gaming table such as that shown in FIG. 8. Table 200 in FIG. 8 may be configured in a semicircular shape appropriate for placement of multiple players and the dealer (who represents the house). The primary distinction is the provision of two betting areas for each player; a first poker betting area 202 and a second sports scoring betting area 204. In this manner each player may effectively bet on both aspects of the game at the same time. A segregated area for a "Winners Purse" may also be provided for the "Players Only" pot that may be utilized in some versions of the casino game method of play as described herein.

In the casino environments there may also be "Multiple Hand Games" where play is similar to the parlor version where there is cumulative scoring over multiple hands. In one embodiment of a Casino Multiple Hand Game, a large screen electronic scoreboard may be used showing players' scores and/or positions. In a casino, a preferred location of these multi-hand table games would be in the sports book area. These Casino Multiple Hand Games would involve the non-bank version only where the house takes a rake and does not participate in game. The play of each hand precedes in much the same manner as described above with the One Hand Games. At the end of each hand, each player's score is determined and posted by the house to the electronic scoreboard and players' poker and score bets are settled, i.e. the pot splits between best poker and best scoring hands. Play continues in the same manner until a set number of hands are completed or, depending on the game being played, until the first player reaches a specified score determined prior to the start of the game. In another embodiment, wagers can be made using the progressive betting method described in the parlor embodiment above, also resulting in the pot being split between best poker and best scoring hands.

A variety of "bonus" embodiments are also anticipated within the casino multi-hand game methods of play. In one such embodiment, all players may be required to place a fixed amount in a bonus pot area designated on the table. The house may elect to take a rake from this pot. The game winner (i.e. the best score over multiple hands) wins the bonus pot. In another version, the house may publish a bonus payout schedule for reaching specified scoring levels.

Various modifications are also anticipated for embodiments involving casino slot machines, casino video games, and hand held devices. Using the combined poker/scoring method of play, slot machine, video games, and/or hand held sports simulation game devices may incorporate programming for single or multiple hand embodiments. In one video game embodiment, for example, a five card video display could be used that allows for the play of poker and sports scoring using the three individual discard/draw sequences described above. At the end of the play sequence, payouts could be based on the poker hand achieved (with odds for each possible poker outcome published on the face of the game apparatus) and on the score achieved, if any (also with odds for each possible score outcome published).

In another multiple hand video game embodiment, a five card video display may be used allowing play for poker and sports score over a fixed or variable number of sequential hands comprising a complete game. In each hand the poker winnings, if any, may be posted to a "credits won" digital display and the score from that hand, if any, may be posted to a digital "scoreboard" that is updated after each hand with the then current cumulative score. At the end of the complete game, the total cumulative score for the game is compared to a payout table and the credits won, if any, may then be posted to the "credits won" digital display. In yet another embodiment of a multiple hand video game, scores achieved during play may trigger bonus events allowing the player the possibility of winning bonus payouts. In a further embodiment, such as a slot machine game, bonus payouts based on individual hand scores could be paid (credited) after each hand as the game progresses, with an additional bonus at the end of the game for achieving scoring levels published on the game apparatus or programmed into the hand held devices.

In one embodiment involving a single hand slot game, a five card reel may be used comprising a total of sixty cards (twelve per reel, insuring no card is duplicated). A total of 56 rank (and score) cards would be used along with four additional bonus cards that trigger bonus actions such as extra spins or instant bonus payouts. The four additional cards could carry relevant sports indicia such as, but not limited to, action words like "HIT", "SCORE", "BASKET", "GOAL", etc. During play, if no bonus action card(s) are displayed in the reel windows, the payout for that hand (spin), if any, is based on the poker and score published payout schedules displayed on the game apparatus. If one or more bonus action cards are displayed, the player may receive additional "free" spin(s) or credits. In another embodiment, the bonus action card may trigger a scoring wheel mechanism, accompanied by audio "celebration" recordings, and further light up an activation device. When a bonus is indicated, the player could activate the device, which sets in motion a scoring wheel where a plurality of scoring outcomes is displayed. Depending on the score achieved on the scoring wheel, if any, an additional bonus display could activate resulting in a random selection of credits won, also accompanied by audio and visual celebration indicators. Bonus credits, if any, would then be posted to a credits won digital display on the game apparatus. To entice higher levels of wagering in casino embodiments, bonus payouts could be based on the level of credits wagered at the outset of play.

In a further embodiment involving a multiple hand slot game, a five card reel may also be used comprising a total of 60 cards (56 combination poker/score cards plus 4 bonus cards). Play is over multiple, consecutive hands, comprising a complete simulated sports game. During play of each hand, poker credits, if any, are posted to a digital display window according to a payout schedule published on the game apparatus. In the same manner, score credits, if any, are posted after each hand to a digital display area according to a payout schedule published on the game apparatus. In this embodiment, bonus credits may be produced when a bonus card appears in one or more of the reel windows. Bonus credits are awarded according to the value of the card appearing in the reel window. The game is completed when the predetermined number of hands are played, or when a predetermined score is achieved. In yet another embodiment, the described five card reel, 60 card combination is used with word indicia replacing the score indicia. In this embodiment, some cards display a bonus word that triggers a bonus action with a possible large bonus payout. When a bonus word is displayed, such as, but not limited to, "RUN, "SCORE", or other similar sports action terms, a bonus wheel is activated, along with audio of a celebrating crowd, and will come to rest on one of a plurality of indicators displayed on the bonus wheel. If the indicator has a scoring value, a further bonus mechanism is activated that results in a bonus payout of varying credit amounts established by the house.

Any number of other types of bonus payouts are anticipated. It is preferred that these bonus events are tied to high scoring or exceptional events in the sporting event method of play such as a "Touchdown" for football; a "Grand Slam" for baseball; a "Three Pointer" for basketball; a "Hole-in-One" for golf, and so on for other types of sports exceptional events. Each of these bonus features further high lights the combination of the game method of play between the game of poker and the sporting event being simulated.

Although the present invention has been described in terms of the foregoing preferred embodiments, this description has been provided by way of explanation only and is not intended to be construed as a limitation of the invention. Those skilled in the art will recognize modifications of the present invention that might accommodate specific environments within which the game method of play is implemented. As indicated above, the game method of play finds particular application in the parlor game environment, the casino game environment and the electronic gaming environment, although its implementation might occur in any of a number of different environments. Modifications to the number of cards and even the configuration of the cards where such modifications are merely coincidental to the type of poker being played or the type of sporting event being simulated will be apparent to those skilled in the art. These modifications do not necessarily depart from the spirit and scope of the methodology of the present invention.

I claim:

1. A method for playing a card game combining elements of poker and elements of a sporting event, the game method of play comprising the steps of:

(a) providing a deck of fifty-six cards comprising the standard fifty-two rank and suit cards with the addition of four cards of rank "1" in each of the standard suits, the deck of cards suitable for playing the game of poker, a plurality of the cards each comprising indicia representing a non-zero numerical score in the sporting event, and each of the remaining cards comprising indicia representing a zero numerical score in the sporting event;

(b) carrying out the play of at least one hand of the game of poker with the deck of cards and determining a poker winner based on the rules of poker; and (c) concurrent with the play of the at least one hand of the game of poker, for every poker hand having at least a rank pair, totaling a sum of the sporting event numerical score indicia present on the cards in that hand and determining a sporting event winner based on the sporting event numerical score totals.

2. The game method of play of claim 1 wherein the sporting event from which the non-zero numerical scores are provided comprises a sporting event selected from a group comprising; baseball, football, basketball, soccer, rugby, golf, bowling, darts, hockey, lacrosse, volleyball, and tennis.

3. The game method of play of claim 1 further comprising the step of betting on the outcome of the play of at least one hand of the game of poker.

4. The game method of play of claim 1 further comprising the step of betting on the outcome of the scoring of the sporting event numerical score totals.

5. The game method of play of claim 3 further comprising the step of betting on the outcome of the scoring of the sporting event numerical score totals.

6. The game method of play of claim 1 wherein the sporting event non-zero numerical score indicia comprise numerical values associated with scoring values that occur during the play of an actual sporting event.

7. The game method of play of claim 6 wherein an appearance frequency of the sporting event non-zero numerical score indicia is generally coincident with a frequency of scoring during the play of an actual game.

8. The game method of play of claim 1 wherein the sporting event non-zero numerical score indicia comprise numerical values associated with final score values that occur after the completed play of an actual sporting event.

9. The game method of play of claim 8 wherein an appearance frequency of the sporting event non-zero numerical score indicia is generally coincident with a statistical frequency of that final score after a completed play of an actual sporting event.

10. The game method of play of claim 1 carried out in a parlor gaming environment comprising a game between individual players.

11. The game method of play of claim 10 further comprising the step of betting on the outcome of the game, the step of betting comprising the players placing betting tokens into a pot during the play of at least one hand of the game of poker.

12. The game method of play of claim 1 carried out in a casino gaming environment comprising a game with a dealer representing the house, and at least one individual player.

13. The game method of play of claim 12 further comprising the step of betting on the outcome of the game, the step of betting comprising the at least one individual player placing betting tokens into a pot during the play of at least one hand of the game of poker.

14. The game method of play of claim 1 carried out in a video gaming environment comprising interaction between an electronic video game and at least one individual player.

15. The game method of play of claim 14 further comprising the step of betting on the outcome of the game, the step of betting comprising the at least one individual player placing betting tokens and/or money into the electronic video game during the play of at least one hand of the game of poker.

16. The game method of play of claim 1 carried out in a slot machine gaming environment comprising interaction between a slot machine and at least one individual player.

17. The game method of play of claim 16 further comprising the step of betting on the outcome of the game, the step of betting comprising the at least one individual player placing betting tokens and/or money into the slot machine during the play of at least one hand of the game of poker and potentially earning an opportunity to spin for bonus winnings.

18. A method for playing a card game combining elements of poker and a elements of a sporting event, the game method of play comprising the steps of:

(a) providing a deck of fifty-six cards comprising the standard fifty-two rank and suit cards with the addition of four cards of rank "1" in each of the standard suits, at least one of the cards having indicia representing a non-zero numerical score in a sporting event;

(b) dealing a hand of at least five cards to each player;

(c) allowing each player in turn to either fold or place a bet on winning the hand, the bet comprising a bet on winning the poker hand, winning the sporting event scoring of the hand, or winning both;

(d) allowing each player in turn to stand on the cards dealt or to discard one card from the hand dealt and draw one card from a number of cards remaining un-dealt;

(e) repeating the steps of (c) and (d) two additional rounds, thereby allowing each player opportunities to bet three times and to discard/draw three times;

(f) allowing each player remaining in the hand in turn, at least one further opportunity to either fold, check, or bet on winning the hand, the bet comprising a bet on winning the poker hand, winning the sporting event scoring of the hand, or winning both;

(g) all remaining players showing the cards in their hands;

(h) determining the winning poker hand among the remaining players and awarding one half of the pot to the player with the winning poker hand;

(i) determining the winning sporting event scoring hand based on the cards in the hands of the remaining players having at least a rank pair and awarding the remainder of the pot to the player with the winning sporting event scoring hand; and (j) recording the scores of all of the players participating in the game.

19. The game method of play of claim 18 wherein the sporting event from which the non-zero numerical scores are provided comprises a sporting event selected from a group comprising; baseball, football, basketball, soccer, rugby, golf, bowling, darts, hockey, lacrosse, volleyball, and tennis.

20. The game method of play of claim 18 further comprising the step of repeating steps (b) through (j) a plurality of times to generate simulated sporting event scoring similar to that generally accumulated during the play of an entire actual sporting event game.

21. The game method of play of claim 20 wherein the simulated sporting event comprises the game of football; the sporting event scoring indicia comprise scores selected from the group of scores comprising: 0, 3, 6, and 7; and steps (b) through (j) are repeated eight times for a complete game.

22. The game method of play of claim 20 wherein the simulated sporting event comprises the game of baseball; the sporting event scoring indicia comprise scores selected from the group of scores comprising: 0 and 1; and steps (b) through (j) are repeated nine times for a complete game.

23. The game method of play of claim 20 wherein the simulated sporting event comprises the game of basketball; the sporting event scoring indicia comprise scores selected from the group of scores comprising: 0, 1, 2, 3, 4, 5, 6, 7, and 8; and steps (b) through (j) are repeated eight times for a complete game.

24. The game method of play of claim 20 wherein the simulated sporting event comprises the game of golf; the sporting event scoring indicia comprise scores selected from the group of scores comprising: par, one under par, and one over par; and steps (b) through (j) are repeated eighteen times for a complete game.

25. A method for playing a card game combining elements of poker and elements of the sport of football, the game method of play comprising the steps of:

(a) providing a deck of fifty-six cards comprising the standard fifty-two rank and suit cards with the addition of four cards of rank "1" in each of the standard suits, the deck of cards suitable for playing the game of poker, a plurality of the cards each comprising indicia representing a non-zero numerical score in the sport of football, namely a numerical score of 1, 2, 3, or 6, and each of the remaining cards comprising indicia representing a zero numerical score;

(b) carrying out the play of eight hands of the game of poker with the deck of cards and, for each of the eight hands of the game, determining a poker hand winner based on the rules of poker;

(c) awarding one or more points to the poker hand winner for each of the eight hands of the game and for each player, accumulating the awarded points through the eight hands of the game;

(d) concurrent with the play of each of the eight hands of the game of poker, for every player's poker hand having at least a rank pair, totaling a sum of the football numerical scores present on the cards in that player's hand and for each player, accumulating the totaled sums through the eight hands of the game; and (e) at the end of eight hands of the game, determining a poker game winner based on the accumulated points and determining a football game winner based on the accumulated totaled sums.

* * * * *